US007510449B2

(12) United States Patent
Ito et al.

(10) Patent No.: US 7,510,449 B2
(45) Date of Patent: Mar. 31, 2009

(54) BOAT STEERING SYSTEM

(76) Inventors: Makoto Ito, 1400 Nippashi-cho, Hamamatsi-shi, Shizuoka-ken (JP) 432-8528; Takashi Yamada, 1400 Nippashi-cho, Hamamatsi-shi, Shizuoka-ken (JP) 432-8528; Isao Kanno, 1400 Nippashi-cho, Hamamatsi-shi, Shizuoka-ken (JP) 432-8528

( * ) Notice: Subject to any disclaimer, the term of this patent is extended or adjusted under 35 U.S.C. 154(b) by 51 days.

(21) Appl. No.: 11/689,314

(22) Filed: Mar. 21, 2007

(65) Prior Publication Data

US 2008/0119096 A1 May 22, 2008

(30) Foreign Application Priority Data

Nov. 22, 2006 (JP) ..... 2006-315736

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

2006/0019552 A1 * 1/2006 Okuyama ..... 440/1
2006/0089060 A1 * 4/2006 Kawase et al. ..... 440/1

FOREIGN PATENT DOCUMENTS

JP 2006-029183 2/2006
JP 2006-035884 9/2006

* cited by examiner

*Primary Examiner*—Stephen Avila
(74) *Attorney, Agent, or Firm*—Knobbe Martens Olson & Bear LLP

(57) ABSTRACT

A steering system for a boat with three or more propulsion units allows the operator to operate the boat in the same manner before and after a failure of one of the propulsion units. The steering system includes not more than two control levers to control three or more propulsion units. A controller can automatically change the control arrangement between the two control levers and the propulsion units when any of the propulsion units is turned off.

22 Claims, 26 Drawing Sheets

BOAT STEERING SYSTEM

RELATED APPLICATIONS

The present application is based on and claims priority under 35 U.S.C. § 119(a)-(d) to Japanese Patent Application No. 2006-315736, filed on Nov. 22, 2006, the entire contents of which is hereby expressly incorporated by reference herein.

BACKGROUND OF THE INVENTION

1. Field of the Invention

The present invention relates to a steering system for a boat with three or more propulsion units arranged side-by-side.

2. Description of the Related Art

Conventional boats may have three propulsion units arranged side-by-side. The propulsion units may be outboard motors, stern drives or inboard-outdrive engines. Each propulsion unit has an associated shift lever and throttle lever. To control the boat, the operator individually operates all six shift and throttle levers.

More recently, steering systems for multi-engine boats have included only two levers. An operator performs shift and throttle operations for all the three propulsion units via the two levers (see, for example, Japanese Patent Abstracts JP-A-2006-29183 and JP-A-2006-35884).

Japanese Patent Abstract JP-A-2006-29183 describes a steering system that has two control levers for a boat having three propulsion units. To facilitate low speed operation, an operator can hold the two control levers at a predetermined position in a neutral range to independently throttle the middle propulsion unit. With the control levers in this position, the two outer propulsion units are idling. The boat can thus move at a very slow speed via operation of only two levers.

Japanese Patent Abstract JP-A-2006-35884 describes a steering system that has two control levers for a boat having three propulsion units. The steering system includes an imaginary lever associated with the middle propulsion unit. The position of the imaginary lever is determined based on the detected positions of the two levers. The operator can thus perform shift and throttle operation for the three propulsion units through the use of only two levers.

In the steering systems above, an operator can throttle the boat to move at a very slow speed. If one of the propulsion units stops, the operator must first return the two levers to the neutral position and turn the start switch to on to restart the propulsion units. However, if the failure occurred in the propulsion unit, the propulsion unit will not restart. The operator then must turn off the main switch associated with the failed propulsion unit and tilt the propulsion unit up to use the two remaining propulsion units to return to port. Unfortunately, the operator cannot predict which of the three propulsion units may fail and how the failure will impact control of the boat.

SUMMARY OF THE INVENTION

In view of the foregoing, a need exists for a steering system for a boat having three or more propulsion units in which an operator can perform shift and throttle operations when one of the propulsion units has failed in the same manner as when operating all of the propulsion units thereby making it easier to reach the shore after the propulsion has failed.

An aspect of the invention is directed to a boat steering system. The system includes at least three propulsion units, a left unit, a right unit, and a middle unit. The system further includes left and right control levers that are associated with the at least three propulsion units to control their operation. The system further includes a main switch for each of the at least three propulsion units and a controller. The controller automatically changes the association between the left and right control levers and the at least three propulsion units if the main switch of any of the at least three propulsion units is turned off.

An aspect of the invention is directed to a boat steering system. The system includes at least three propulsion units, a left unit, a right unit, and a middle unit. The system includes a main station that has a first set of left and right control levers. The first set of control levers are associated with the at least three propulsion units. The system further includes a sub station having a second set of left and right control levers. The second set of control levers are associated with the at least three propulsion units so that control of the at least three propulsion units is switchable between the main station and the sub station.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional boat steering systems.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. In this description, reference is made to the drawings wherein like parts are designated with like numerals throughout the description and the drawings.

Embodiments of a boat steering system according to the present invention will now be described. It should be understood that the disclosed embodiments are the preferred embodiments of the present invention and are not intended to limit the scope of the present invention.

Figure 1:
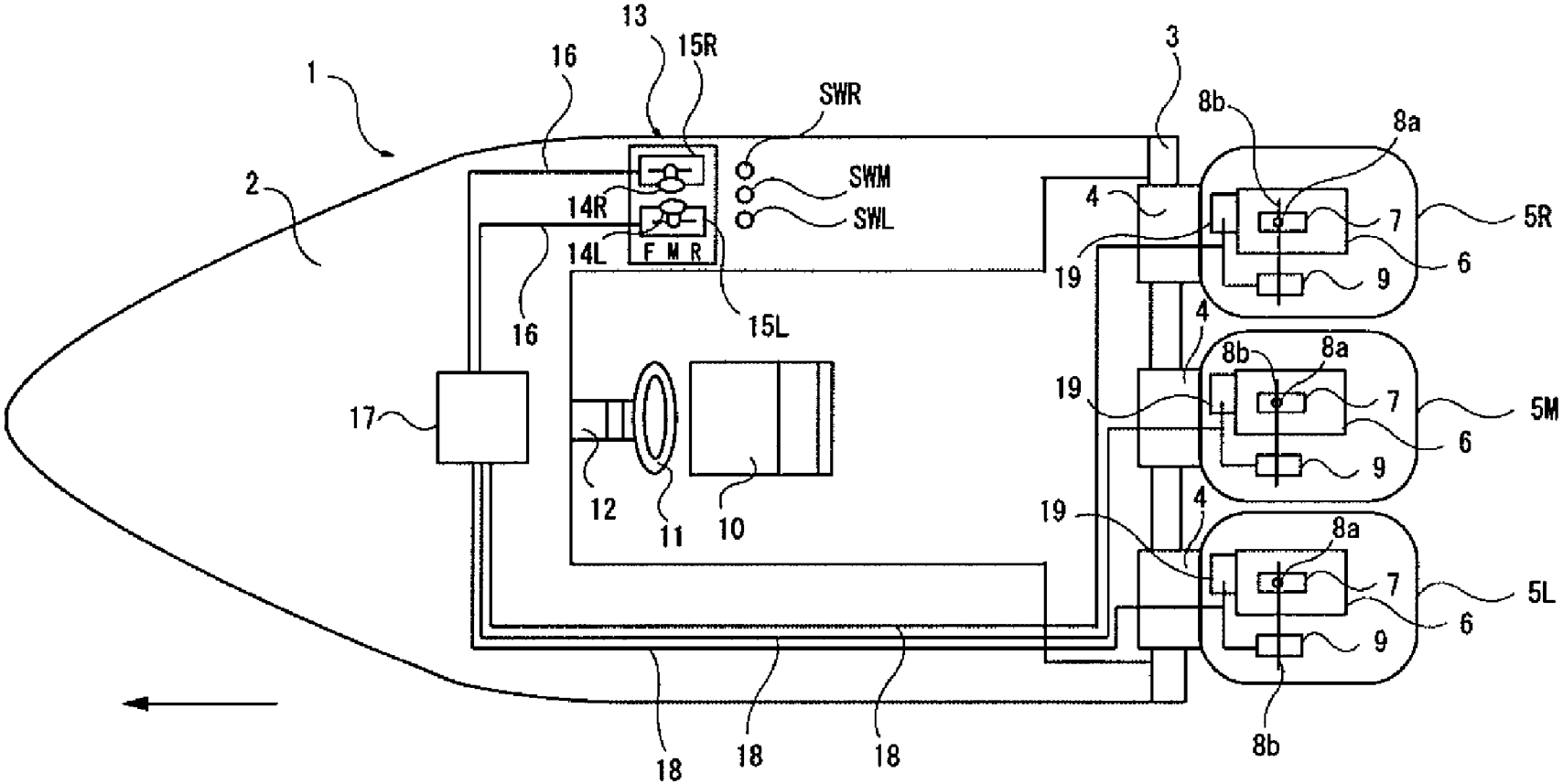
FIG. 1 is a schematic plan view of a boat with a steering system configured in accordance with a preferred embodiment of the present invention.

FIG. 1 is a schematic plan view of a boat 1 with a steering system configured in accordance with a preferred embodiment of the present invention. As used herein, a boat 1 is a vehicle, vessel, or craft designed to move across (or through) water. The boat 1 includes a hull 2 and at least three propulsion units 5L, 5M, 5R coupled to the hull 2. Alternatively, the boat 1 may include four or more propulsion units. Each propulsion unit 5L, 5M, 5R is mounted to a transom 3 of the hull 2 via a clamp bracket 4. In this embodiment, the propulsion units are outboard motors. Alternatively, one or more of the propulsion units may be a stern drive, an inboard-outdrive engine, or other type of boat propulsion device.

For ease of explanation, the propulsion unit on the left, the propulsion unit on the right, and the propulsion unit in the middle are hereinafter respectively referred to as left propulsion unit 5L, right propulsion unit 5R, and middle propulsion unit 5M with respect to the forward direction indicated by the arrow in FIG. 1. For a boat 1 with four propulsion units, the leftmost propulsion unit is referred to as left propulsion unit 5L and the rightmost propulsion unit is referred to as right propulsion unit 5R. The two middle propulsion units are referred to as middle propulsion units 5M. This same identification scheme would apply to embodiments having more than four propulsion units.

Each propulsion unit 5L, 5M, 5R has an engine 6. The engine 6 includes an intake system. The intake system may include a carburetor such as a throttle body 7, fuel injection, or other type of fuel delivery device. The throttle body 7 limits the amount of airflow to the engine 6 so as to control the speed and torque of the engine 6. The throttle body 7 may include an electric throttle valve 8*a* and a motor 9. A valve shaft 8*b* of the throttle valve 8*a* is connected to the motor 9. The motor 9 may be electronically controlled and selectively opens and closes the throttle valve 8*a*. An operator steers the boat 1 with a steering wheel 11 that is disposed in the hull 2 and faces the operator's seat 10. The steering wheel 11 is attached to the hull 2 via a steering wheel shaft 12.

In proximity to the operator's seat 10 is a remote controller 13. The operator operates the remote controller 13 to remotely control the propulsion units 5L, 5M, 5R. The remote controller 13 includes a left remote control lever 14L and a right remote control lever 14R. The control levels are identified as being left (L) or right (R) with respect to the forward direction. The remote controller 13 also includes potentiometers 15L, 15R for detecting the positions of their respective remote control levers 14L, 14R. The propulsion units 5L, 5M, 5R are operatively electrically connected to the two adjacent remote control levers 14L, 14R. The remote control levers 14L, 14R allow the operator to control shift actuators and throttle actuators of the propulsion units 5L, 5M, 5R.

The operator controls the remote controller 13 through the remote control levers 14L, 14R. By controlling the remote controller 13, the operator controls the shifts and openings of the throttle valves 8*a* of the propulsion units 5L, 5M, 5R. Controlling the shifts and the openings of the throttle valves 8*a* controls the propulsion force of the propulsion units 5L, 5M, 5R and the speed of the boat 1. The left remote control lever 14L is used to control the shift and the opening of the throttle valve 8*a* (e.g. propulsion force) of the left propulsion unit 5L. The right remote control lever 14R is used to control the shift and the opening of the throttle valve 8*a* (e.g. propulsion force) of the right propulsion unit 5R.

For example, with the remote control lever 14L, 14R at a center position the selected shift mode is a neutral (N) mode. When the lever 14L, 14R is tilted forward from the center position, the selected shift mode is a forward (F) mode. When the lever 14L, 14R is tilted rearward, the selected shift mode is a reverse (R) mode. With the shift mode in the forward (F) mode and the remote control lever 14L, 14R is further tilted forward, the throttle valve 8*a* gradually moves from a fully closed position to a fully open position. With the shift mode in the reverse (R) mode and the remote control lever 14L, 14R is tilted further rearward, the throttle valve 8*a* will gradually move from a fully closed position to a fully open position. As such, the operator can control the propulsion force of the propulsion unit 5L, 5M, 5R during both forward running and reverse running by selectively opening and closing the associated throttle valves 8*a* through the remote control levers 14L, 14R.

Signals are sent from the remote controller 13 to a control unit 17 via a signal cable 16. The control unit 17 receives information on the positions of the remote control levers 14L, 14R outputted from the potentiometer 15L, 15R. The control unit 17 processes the received information and outputs an operation command signal to the associated propulsion unit 5L, 5M, 5R. The propulsion unit 5L, 5M, 5R receives signals from the control unit 17 via a signal cable 18. An electric shift mechanism 19 associated with the engine 6 shifts the engine 6 to the forward mode or the reverse mode.

The illustrated embodiment includes a main switch SWL, a main switch SWM, and a main switch SWR. The switches may be disposed near seat 10. The main switches SWL, SWM, SWR are respectively associated with the propulsion units 5L, 5M, 5R. Operating the main switch SWL, SWM, SWR causes the engine 6 associated with the selected propulsion unit 5L, 5M, 5R to start. A steering actuator may be provided in the hull 2 to turn the associated propulsion unit about its swivel shaft (not shown) in response to the operator turning the steering wheel 11.

Figure 2:
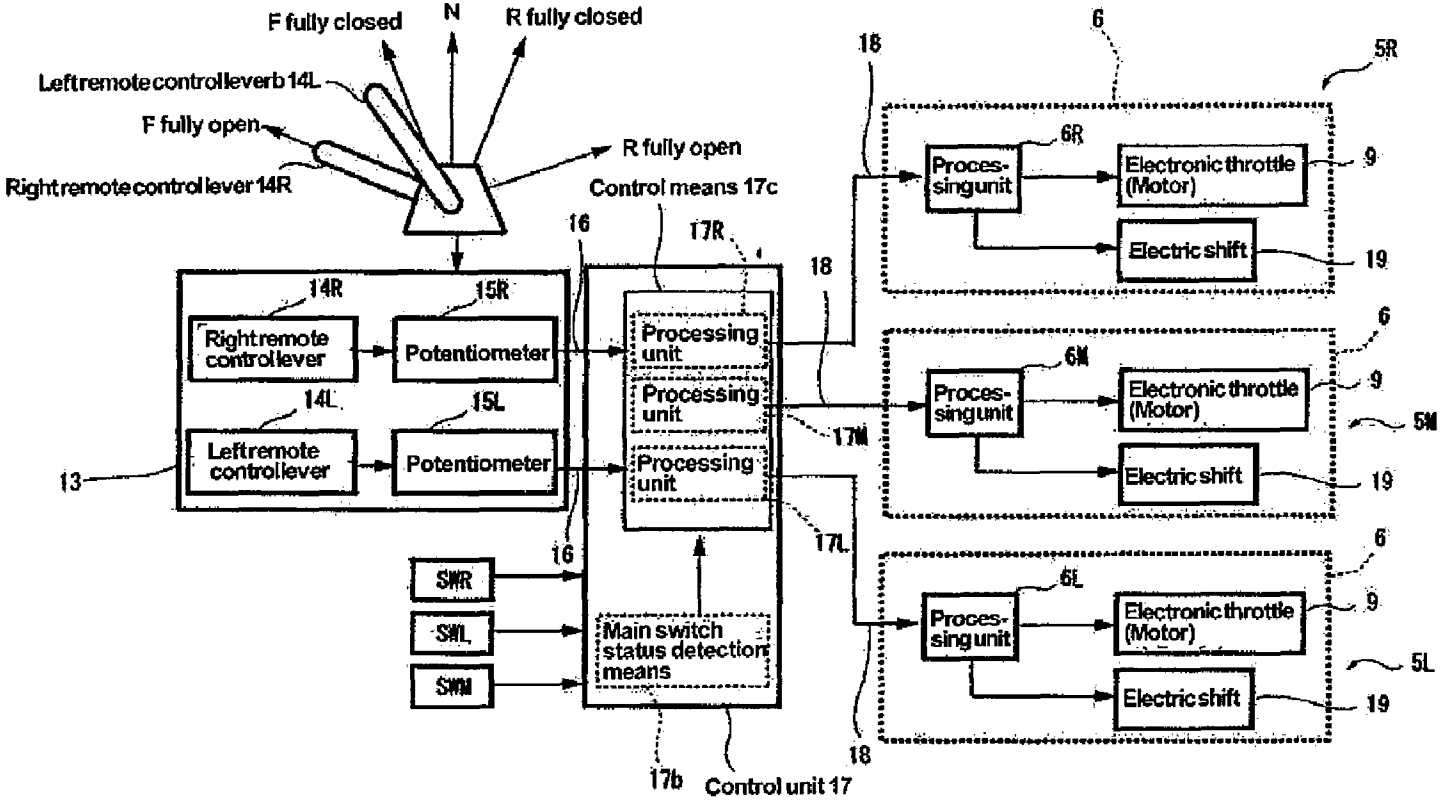
FIG. 2 is a block diagram of the steering system from FIG. 1.
Figure 3:
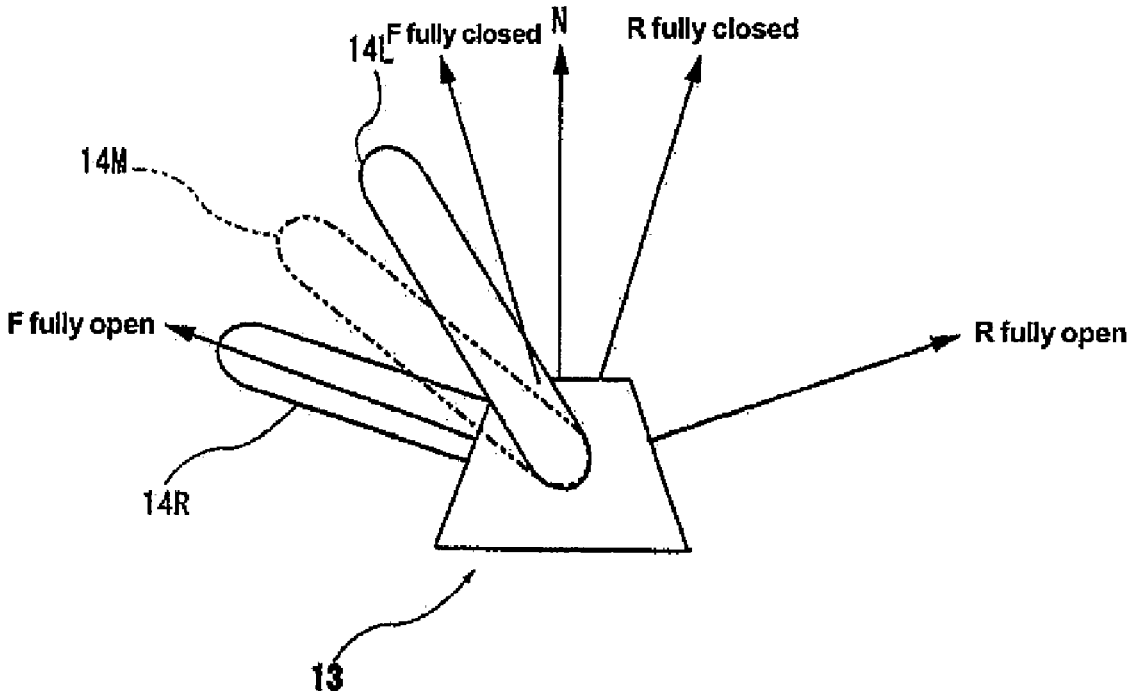
FIG. 3 illustrates a remote controller for the steering system from FIG. 1.

FIG. 2 is a block diagram of the steering system from FIG. 1. The steering system includes a remote controller 13, main switches SWL, SWM, SWR, a control unit 17, and propulsion units 5L, 5M, 5R. As the remote control lever 14L, 14R is tilted forward from the neutral (N) position, the shift mode is set to a forward (F) mode at an F fully closed position, where the throttle valve is closed (i.e. minimum opening). As the lever is tilted further forward and held at an F fully open position, a maximum throttle opening is obtained. The same description applies in a reverse (R) mode. As a result, when the lever is within the range between the F fully closed position and the R fully closed position, the shift is in the neutral mode.

The position of the left remote control lever 14L of the remote controller 13 is detected by the associated potentiometer 15L. The detected information is provided to a processing unit 17L. The processing unit 17L is disposed within the control means 17*c* of the control unit 17. Likewise, a position of the right remote control lever 14R is detected by the associated potentiometer 15R. The detected information is inputted to a processing unit 17R of the control means 17*c*. The information inputted to the processing unit 17L and the processing unit 17R are transmitted to a processing unit 17M.

The processing unit 17L processes the position information for the left remote control lever 14L and outputs operation command signals to the electronic throttle valve (i.e. motor 9) and to an electric shift mechanism 19 for the left propulsion unit 5L. The processing unit 17R processes the position information for the right remote control lever 14R and outputs operation command signals to the electronic throttle valve (i.e. motor 9) and to an electric shift mechanism 19 for the right propulsion unit 5R.

Using the position information for the left remote control lever 14L and the right remote control lever 14R, the processing unit 17M determines target shift and throttle positions for the engine 6 of the central propulsion unit 5M according to various routines (to be described in greater detail below). The processing unit 17M then outputs operational command signals indicating the target shift and throttle positions to an electronic throttle valve (i.e. motor 9) and an electric shift mechanism 19 of the central propulsion unit 5M. A processing unit 6L, 6M, 6R in each engine 6 converts a signal outputted from the control unit 17 into operation command signals for the electronic throttle valve (i.e. motor 9) and the electric shift mechanism 19. The processing unit 6L, 6M, 6R may determine the target shift and throttle positions for the propulsion unit 5L, 5M, 5R. For example, the control unit 17 on the hull side may transmit information on a position of the remote control lever to the processing unit 6L, 6M, 6R of the propulsion unit 5L, 5M, 5R.

The control unit 17 may include main switch status detection means 17*b* for detecting an on/off status of the main switches SWL, SWM, SWR. The control means 17*c* of the control unit 17 controls the engine 6 of the propulsion unit 5L, 5M, 5R in response to the detected status of the main switch SWL, SWM, SWR. When the main switch SWL, SWM, SWR is turned "on", the control means 17*c* supplies power to the engine 6 of the associated propulsion unit. When the main switch SWL, SWM, SWR is held at a start position, the control means 17*c* starts the engine 6. The control means 17*c* also performs a lever switching control (to be described in greater detail below) in which the connection between the control lever and the propulsion unit is automatically switched.

The manner for selecting target shift and throttle positions for the engine 6 of the middle propulsion unit 5M in accordance with the embodiment illustrated in FIG. 1 is described with respect to FIGS. 3 through 9. In the cited figures, a control lever 14M indicated by chain double-dashed lines is an imaginary remote control lever which represents the operational state of the middle propulsion unit 5M. A position of the imaginary lever 14M is determined based on a position of at least one of the remote control levers 14L, 14R. For example in FIG. 3, the imaginary lever 14M is positioned between the control levers 14L and 14R.

Figure 4:
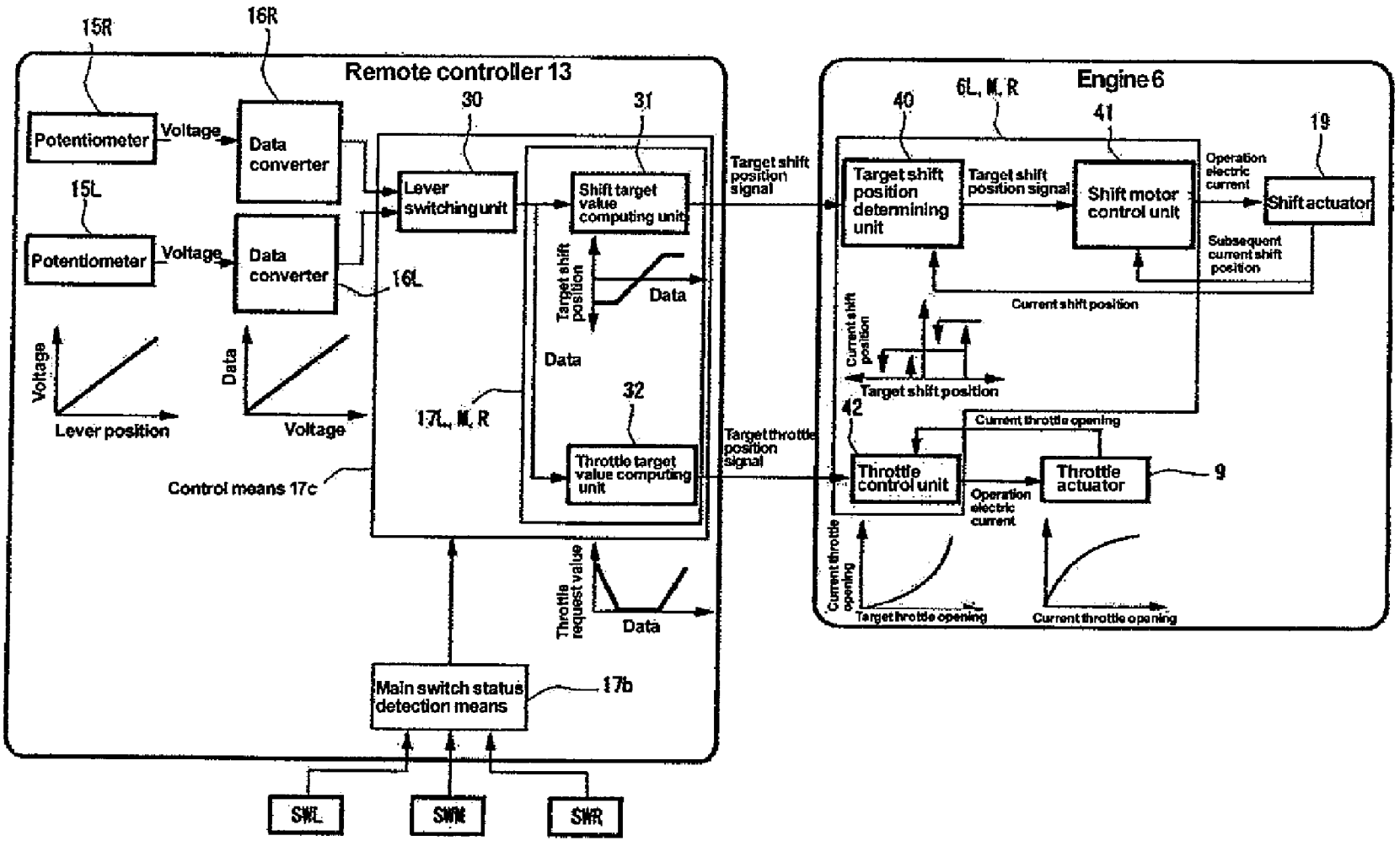
FIG. 4 illustrates a data flow between the remote controller and an engine from FIG. 1.

FIG. 4 illustrates a data flow between the remote controller 13 and the engine 6 from FIG. 1. When a position of the remote control lever 14L, 14R is read, the potentiometer 15L, 15R outputs a voltage signal based on the lever position. A data converter 16L, 16R outputs data based on the inputted voltage to a lever switching unit 30 of the control means 17*c*. In the control unit 17, the main switch status detection means 17*b* detects an "on" state of the main switch SWL, SWM, SWR. When the "on" state of the main switch SWL, SWM, SWR is detected, the control means 17*c* supplies power to the engine 6 of the propulsion unit 5L, 5M, 5R. When the main switch SWL, SWM, SWR is held at the start position, the control means 17*c* starts the engine 6 of the propulsion unit 5L, 5M, 5R. The lever switching unit 30 outputs data based on the position of the remote control lever 14L, 14R to the processing unit 17L, 17R. The data is then inputted from the processing unit 17L, 17R to the processing unit 17M.

A shift target value computing unit 31 computes a target shift position for the engine of the propulsion unit 5L, 5M, 5R based on the inputted data and outputs a signal indicating the target shift position. A throttle target value computing unit 32 computes a throttle request value for the engine of the propulsion unit 5L, 5M, 5R based on the inputted data and outputs a signal indicating the target throttle position.

A target shift position determining unit 40 compares information received from the shift actuator 19 on the current shift position with information received from the shift target value computing unit 31 on the target shift position. The target shift position determining unit 40 then outputs a target shift position signal to a shift motor control unit 41. The shift motor control unit 41 compares subsequent information on a current shift position based on a signal fed back from the shift mechanism 19 of the shift actuator with the information on the target shift position. The shift motor control unit 41 supplies an optimal amount of electric current to the shift actuator so that the shift mechanism 19 achieves the target shift position.

A throttle control unit 42 compares information from the electronic throttle valve (i.e. motor 9) of the throttle actuator on a current throttle opening with information from the throttle target value computing unit 32 on the target throttle opening. The throttle control unit 42 then outputs a target throttle opening signal corresponding to the target throttle opening. As a result, an optimal amount of electric current is supplied to the throttle actuator so that actuation of the electronic throttle valve (i.e. motor 9) achieves the target throttle opening and a predetermined engine speed.

Figure 5:
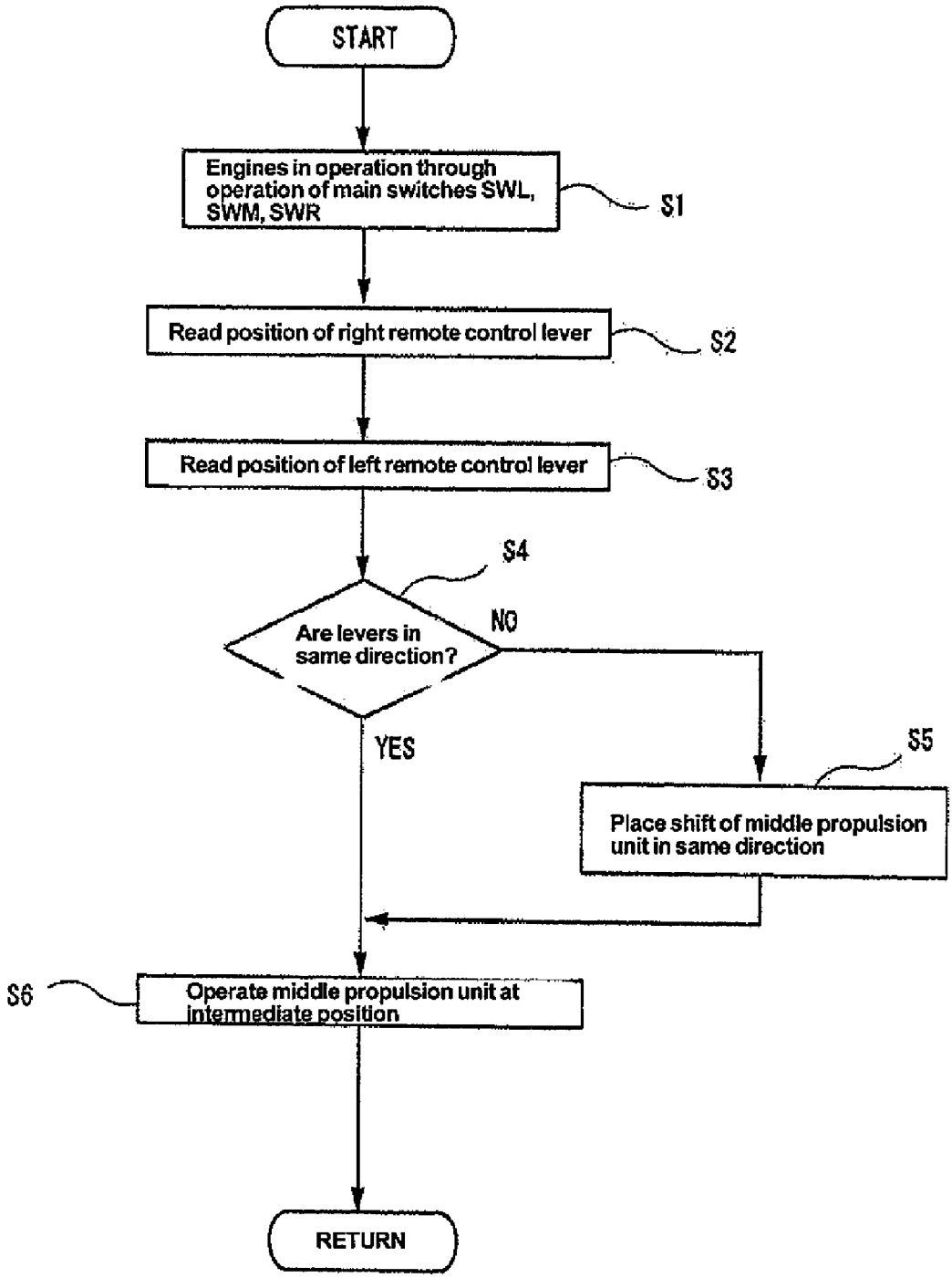
FIG. 5 is a flowchart of an exemplary process performed by the control unit from FIG. 1.

FIG. 5 is a flowchart of an exemplary process performed by the control unit 17 from FIG. 1. The program for the processing may be stored in a memory device in the control unit 17. The program may be periodically executed on a predetermined time interval.

The process begins at a Step S1 where the engines 6 are in operation through operator's operation of the main switches SWL, SWM, SWR. Next, at Step S2, a position of the right remote control lever 14R is determined. Moving to a Step S3, a position of the left remote control lever 14L is determined. At decision block Step S4 it is determined whether or not the right remote control lever 14R and the left remote control lever 16 are in the same forward or reverse direction. If the right remote control lever 14R and the left remote control lever 16 are in the same forward or reverse direction, then the process proceeds to Step S5. At Step S5, the shift of the middle propulsion unit is placed in the same forward or reverse direction as the remote control levers 14L, 14R. The process proceeds to Step S6 where an intermediate position between the positions of the remote control levers 14L, 14R is determined (indicative of the rotational position of the imaginary middle remote control lever 14M). Then the process moves to a Step S7 where the imaginary middle remote control lever 14M is held at the intermediate position between the positions of the remote control levers 14L, 14R. As a result, the middle propulsion unit 5M is operated at an engine speed based on the position of the imaginary middle remote control lever 14M. Fore example, the engine speed of the middle propulsion unit 5M may be the intermediate speed between the engine speeds of the left propulsion unit 5L and the right propulsion unit 5R.

Returning to the decision block S4, if the right remote control lever 14R and the left remote control lever 16 are not in the same forward or reverse direction, then the process returns to step S1.

Figure 6A:
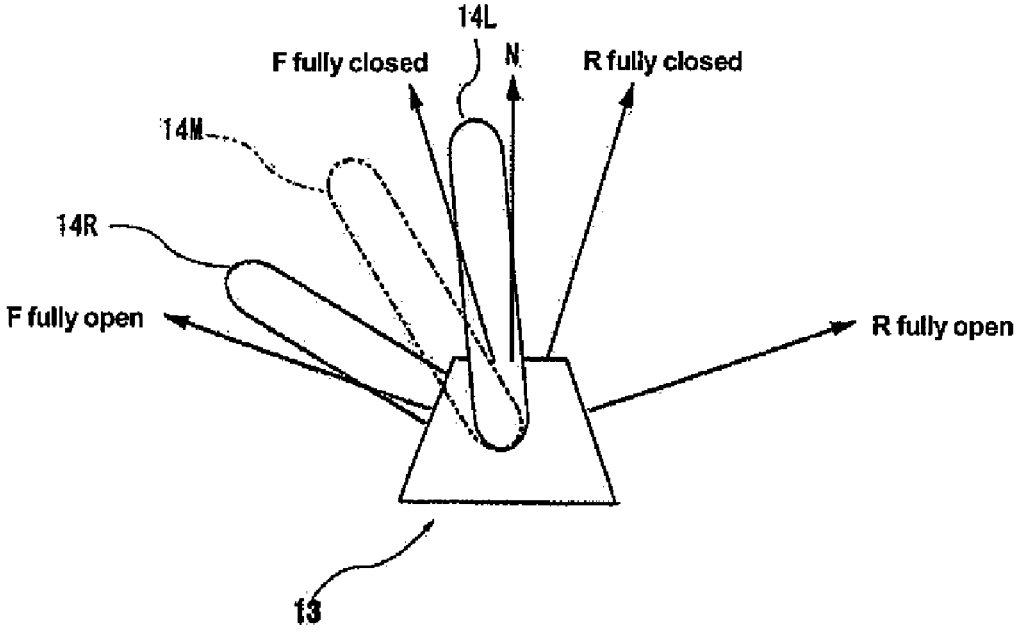
FIGS. 6(*a*) and 6(*b*) illustrate two remote control levers in exemplary rotational positions as well as an imaginary control lever.
Figure 6B:
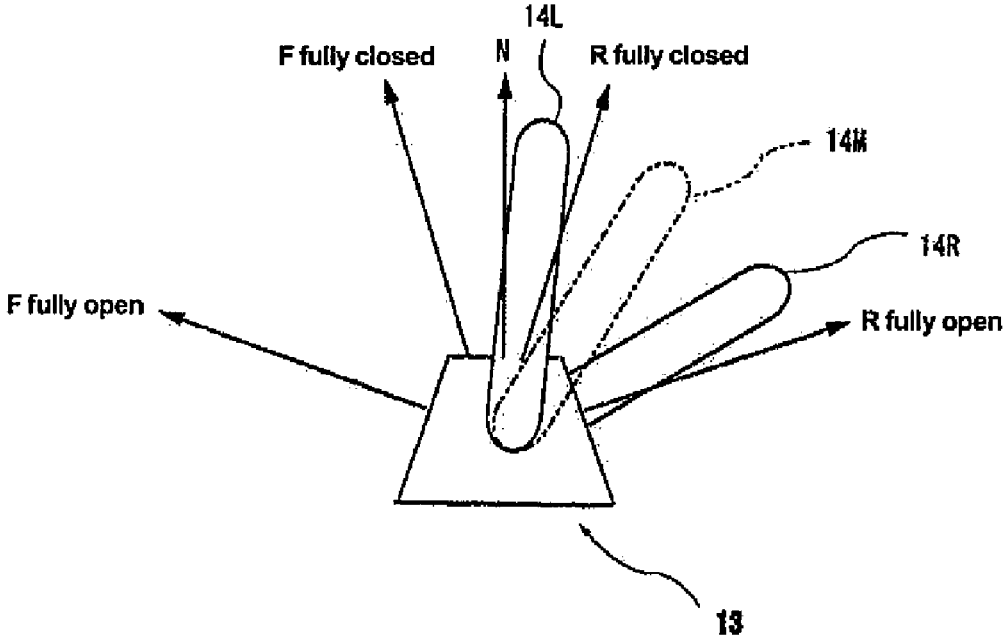

FIGS. 6(*a*) and 6(*b*) illustrate two remote control levers 14L, 14R in exemplary rotational positions with respect to the remote controller 13 as well as an imaginary control lever 14M. When the engines 6 of the propulsion units 5L, 5M, 5R are "on," the control means 17*c* and lever switching unit 30 are not performing any lever switching control to the propulsion units 5L, 5M, 5R.

When the levers are operated in the same forward or reverse direction, the control means controls such that the middle propulsion unit is operable in the same forward or reverse direction. As a result, during normal forward running and reverse running, the output from all the engines of the propulsion units can be used as propulsion force in the same direction. During turning, when the two levers are tilted in opposite directions for a boat that has two propulsion units, the output from the engines of the two propulsion units can be used as propulsion force in opposite directions to make the boat turn.

For example, when both levers 14L, 14R are operated in the forward direction as shown in FIG. 6(*a*) or in the reverse direction as shown in FIG. 6(*b*), the system sends a signal to the middle propulsion unit 5M. The processing unit 6M places the shift in the same forward or reverse direction and selects a predetermined throttle location for the middle propulsion unit 5M. As explained with respect to the description of FIG. 4, the shift target value computing unit 31 computes a target shift position for the engine of the propulsion unit 5M based on the positions of the levers 14L, 14R inputted from the data converter 16L, 16R. The shift target value computing unit 31 outputs a signal indicating the target shift position. The throttle target value computing unit 32 computes a throttle request value for the engine 6 of the propulsion unit 5M based on the inputted data on the positions of the levers 14L, 14R. The throttle target value computing unit 32 outputs a signal indicating the target throttle position.

A signal is transmitted to the computing unit 6L, 6M, 6R in the engine 6 of the propulsion unit 5L, 5M, 5R to place the shift in the same forward or reverse direction and select a predetermined throttle position. Actuation of the shift mechanism 19 of the shift actuator of the middle propulsion unit 5M achieves a target shift position. Actuation of the electronic throttle valve (i.e. motor 9) of the throttle actuator of the middle propulsion unit 5M achieves a target throttle position. As a result, the engine speed of the middle propulsion unit 5M will correspond to the position of the imaginary middle remote control lever 14M. Specifically, the engine speed of the middle propulsion unit 5M will be an intermediate speed between the engine speeds of the left propulsion unit 5L and the right propulsion unit 5R. During normal forward running or reverse running, the output from all the engines 6 of the propulsion units 5L, 5M, 5R propel the boat 1 in the same direction.

Figure 7A:
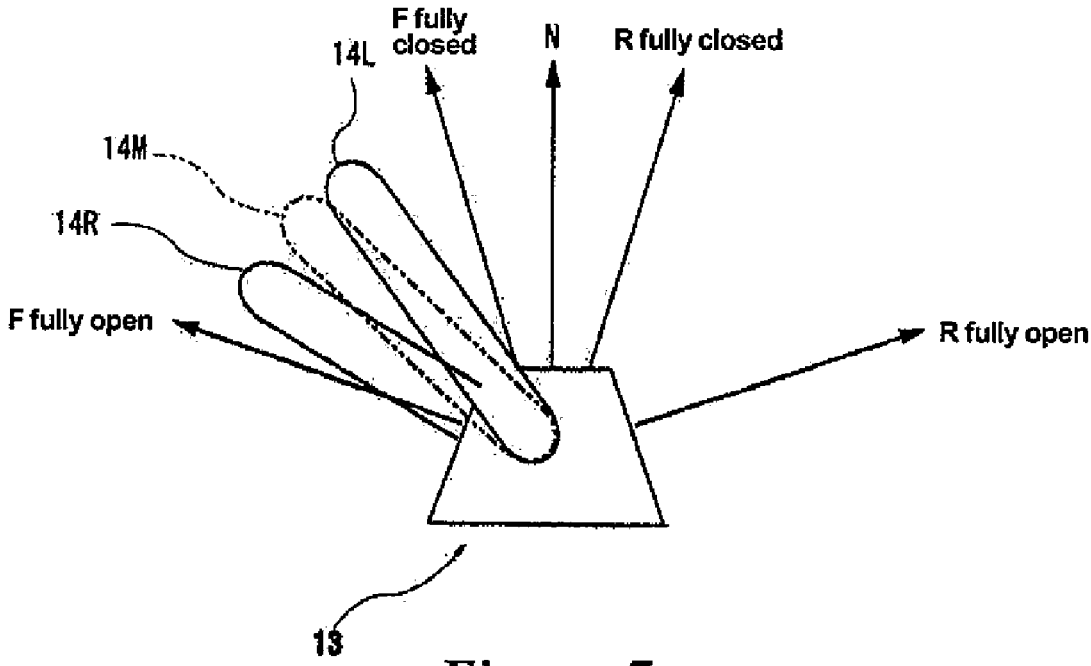
FIGS. 7(*a*) and 7(*b*) illustrate the two remote control levers in a second set of rotation positions and the imaginary control lever.
Figure 7B:
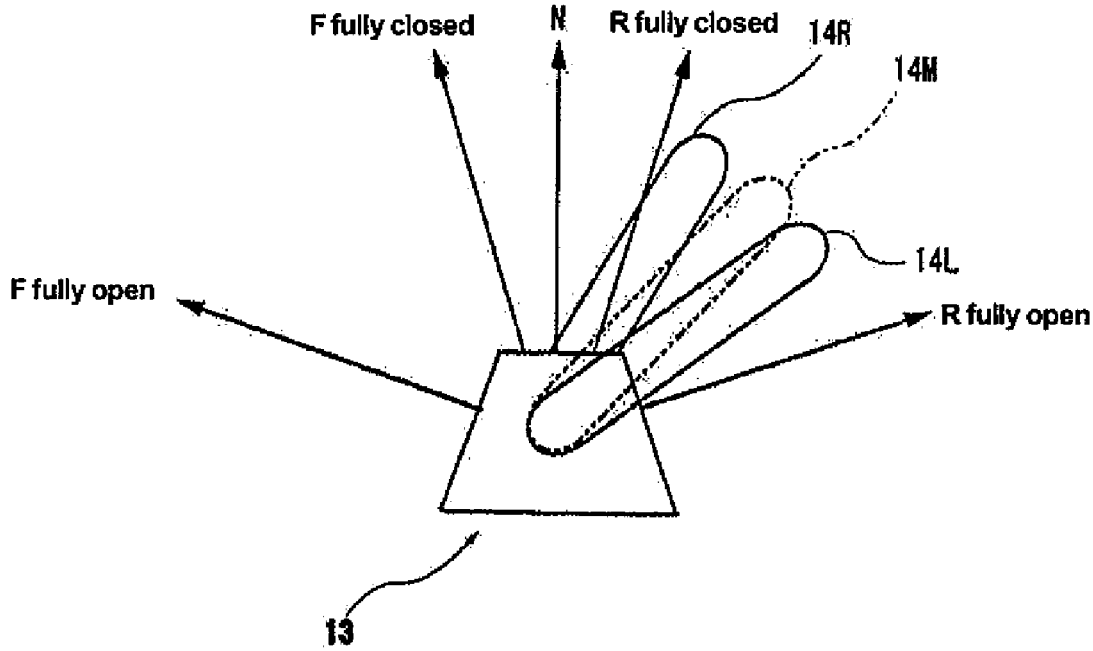

FIGS. 7(*a*) and 7(*b*) illustrate the two remote control levers 14L, 14R in a second set of rotation positions and the imaginary control lever 14M. When the two remote control levers 14L, 14R are operated in the forward direction as shown in FIG. 7(*a*) or in the reverse direction as shown in FIG. 7(*b*) and the control means 17 and the lever switching unit 30 are not performing any lever switching control to the propulsion units 5L, 5M, 5R, the system determines an intermediate position between the positions of the levers 14L, 14R. Then, assuming the presence of the middle remote control lever 14M at this intermediate position, the system outputs a signal to the processing unit 6*a* in the engine 6 of the middle propulsion unit 5M based on the determined position. When running, the boat 1 is turned by rotating the levers 14L, 14R away from each other. As a result, the throttle valve of the middle propulsion unit 5M is controlled so as to achieve a target throttle position based on an intermediate position between the positions of the levers 14L, 14R. A smooth turn is achieved.

When the two levers are operated in the same forward or reverse direction, the middle propulsion unit is controlled to achieve a target throttle opening determined based on an intermediate position between positions of the levers. To make the boat turn when running, the two levers are displaced from each other as with a boat that has two propulsion units.

Figure 8A:
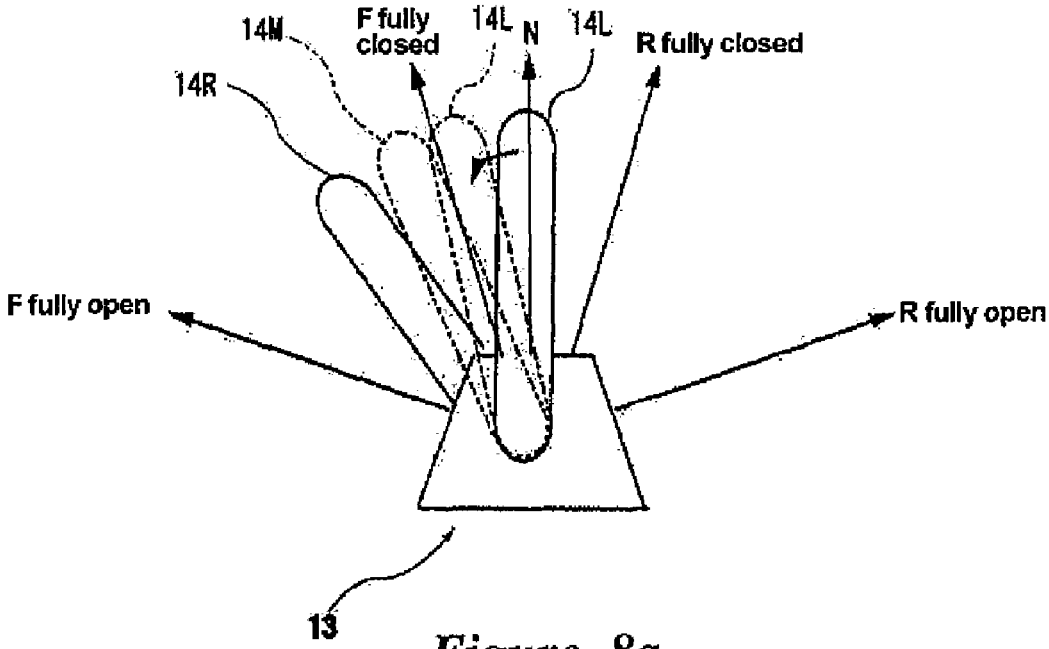
FIGS. 8(*a*) and 8(*b*) illustrate the two remote control levers in a third set of rotational positions and the imaginary control lever.
Figure 8B:
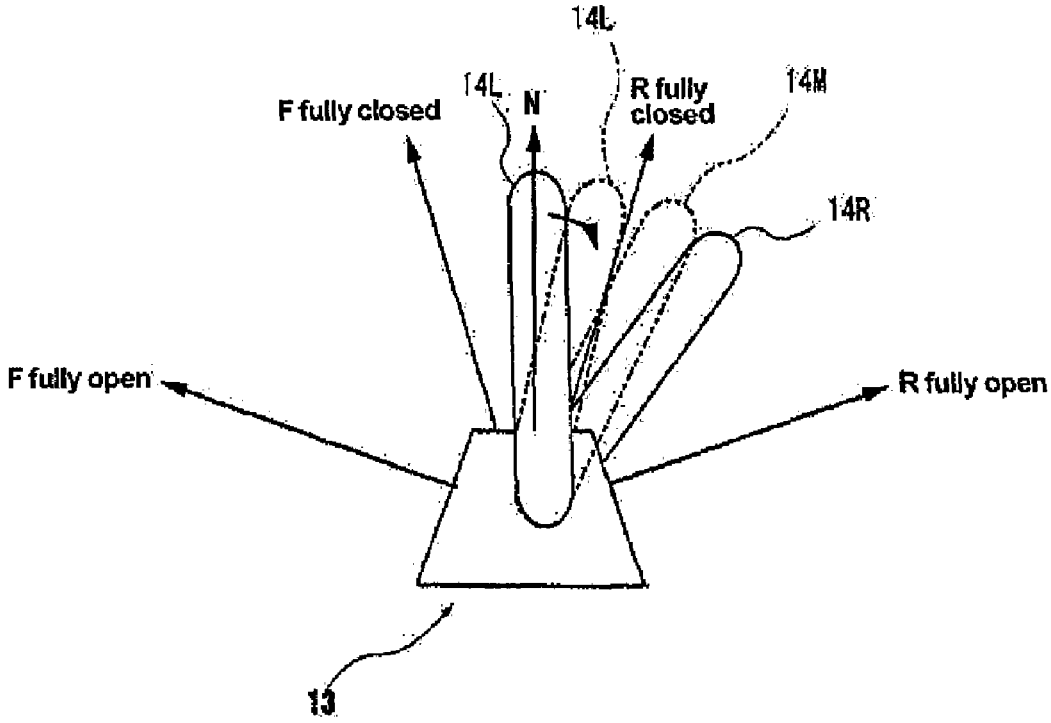

FIGS. 8(*a*) and 8(*b*) illustrate the two remote control levers 14L, 14R in a third set of rotational positions and the imaginary control lever 14M. When one of the levers 14L, 14R, for example the lever 14R, is at the fully open position and the other lever, for example the lever 14L, is at the neutral position, if the lever 14L is tilted to the fully closed position, the processing unit 17M outputs a signal to the engine 6 of the middle propulsion unit 5M. The outputted signal actuates the electronic throttle valve (i.e. motor 9) to gradually increase engine speed. Since the middle propulsion unit 5M is being controlled even when the lever 14L is moved from the neutral position to the fully closed position, a sharp increase in the speed of the engine 6 of the middle propulsion unit 5M is avoided.

When one of the two levers is at the fully open position and the other lever is at the neutral position, if the other lever is operated to the fully closed position, the middle propulsion unit is controlled such that its throttle valve is gradually opened to achieve an intermediate engine speed between engine speeds of the left propulsion unit and the right propulsion unit. As a result, an abrupt increase in the engine speed of the middle propulsion unit can be avoided.

Figure 9A:
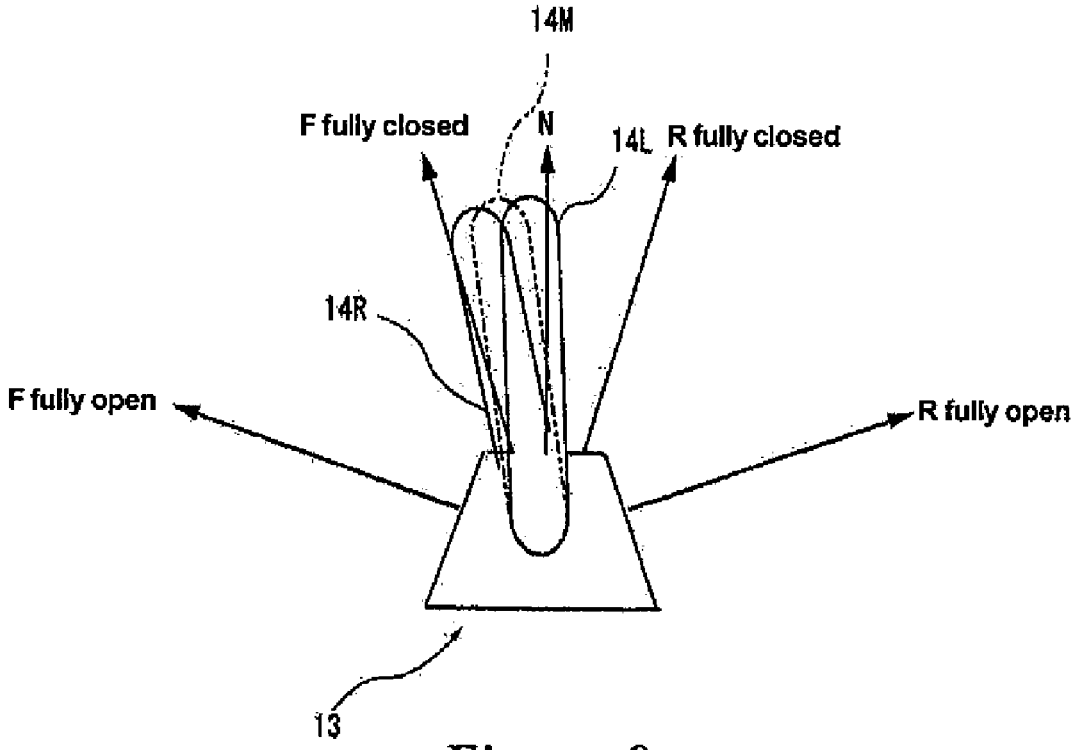
FIGS. 9(*a*) and 9(*b*) illustrate the two remote control levers in a fourth set of rotational positions and the imaginary control lever.
Figure 9B:
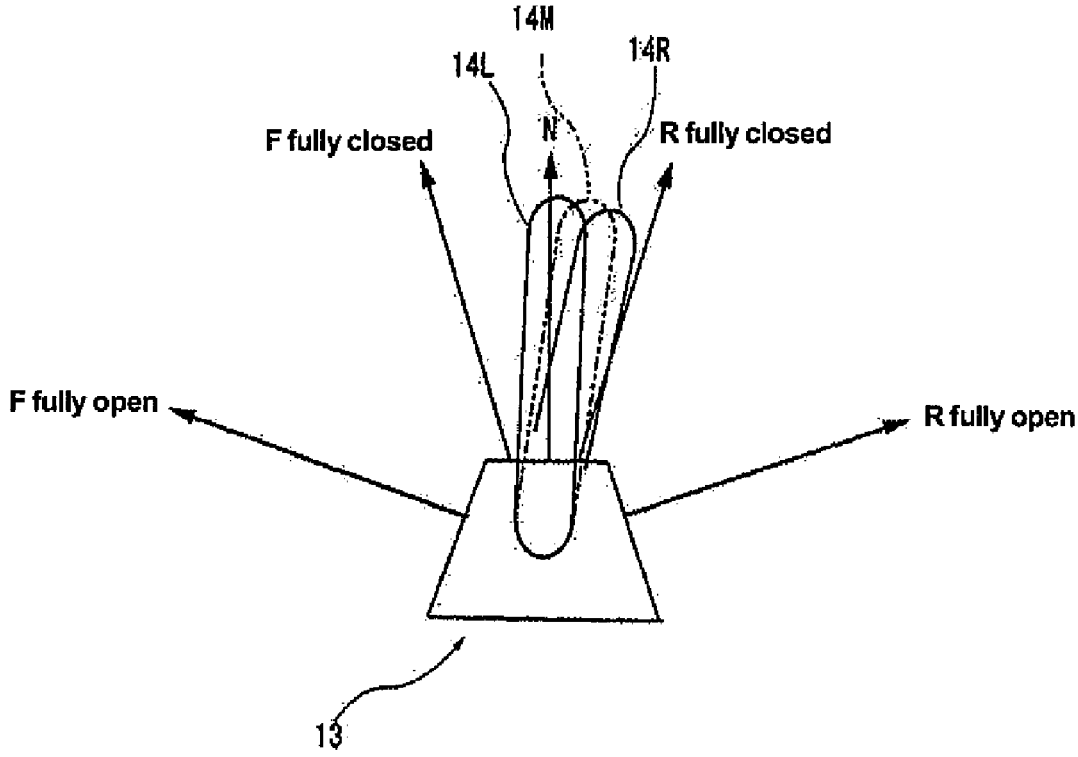
Figure 10B:
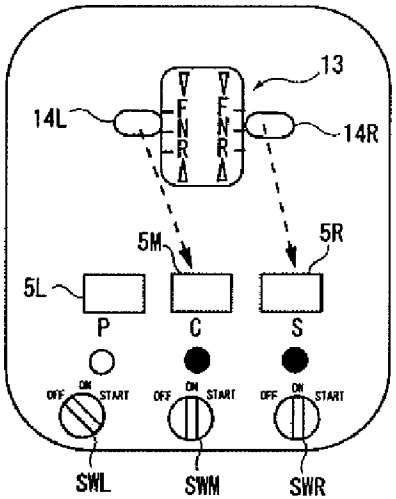
FIGS. 10(*a*), 10(*b*), 10(*c*) and 10(*d*) illustrate a process for switching which lever controls which propulsion unit using the main switches.
Figure 10D:
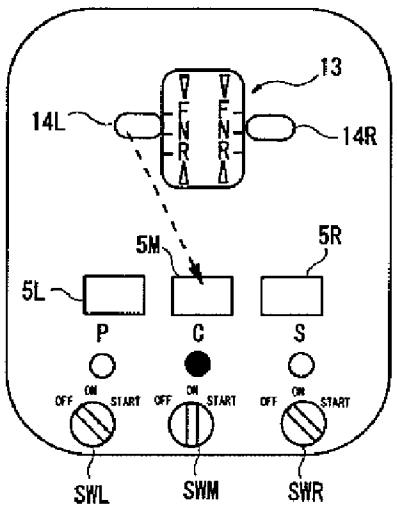
Figure 10A:
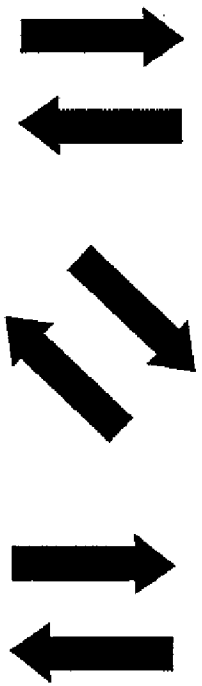
Figure 10A:
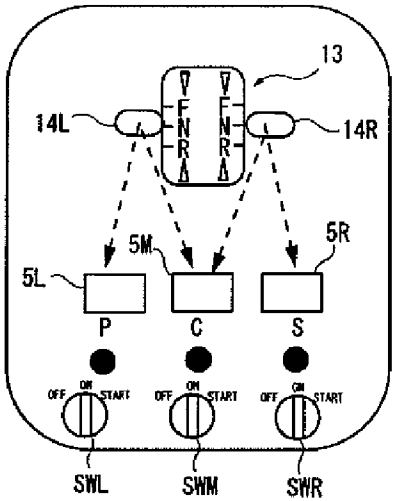
Figure 10C:
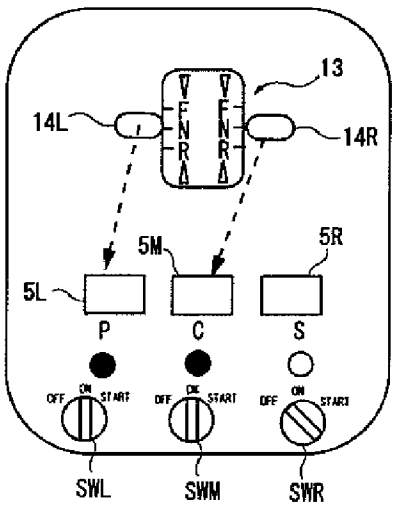

As shown in FIGS. 9(*a*) and 9(*b*), when the levers 14L, 14R are operated in the same forward or reverse direction and held at an intermediate position between the neutral position and the fully closed position, the processing unit 17M computes a target shift position based on the position of the levers 14L, 14R that is nearest to the neutral position in the shift target value computing unit 31. The processing unit 17M outputs a signal indicative of the target shift position to the processing unit 6M in the engine 6 of the middle propulsion unit 5M. The target shift position determining unit 40 compares information on a current shift position based on a signal fed back from the shift mechanism 19 of the shift actuator with the information on the target shift position inputted from the shift target value computing unit 31. The target shift position determining unit 40 then outputs a target shift position signal to the shift motor control unit 41. The shift motor control unit 41 in turn supplies an optimal amount of electric current to the shift actuator 19 such that the shift actuator 19 achieves the target shift position. As described above, when the levers 14L, 14R are held at an intermediate position between the neutral position and the fully closed position, the shift mode of the middle propulsion unit 5M is the neutral position.

When the two levers are operated in the same forward or reverse direction and held at a position before the fully closed position, the middle propulsion unit is controlled to achieve a target shift and throttle position based on a position of one of the levers that is nearer to the neutral position. As a result, the shift of the middle propulsion unit will be placed in the neutral position, so that an abrupt increase in engine speed can be prevented.

FIGS. 10(*a*), 10(*b*), 10(*c*) and 10(*d*) illustrate a process for switching which lever controls which propulsion unit using the main switches. The embodiment illustrated in FIGS. 10(*a*) through 10(*d*) may include active lamps P, C, S. The active lamps P, C, S are associated with the engines 6 of the respective propulsion units 5L, 5M, 5R. When the engine 6 of the propulsion unit 5L, 5M, 5R is in operation, the active lamp P, C, S illuminates. When not in operation, the active lamp P, C, S is off.

As shown in FIGS. 2, 4 and 10(*a*), when the main switches SWL, SWM, SWR are "on", the main switch status detection means 17*b* detects an "on" state of the main switches SWL, SWM, SWR. When the main switches SWL, SWM, SWR are "on," the control means 17*c* does not switch the control mode of the engines 6 of the propulsion units 5L, 5M, 5R, but instead controls the engines 6 of the propulsion units 5L, 5M, 5R as described with respect to FIGS. 1 through 9.

The control means 17*c* automatically switches the connection between the control lever and the propulsion unit when the main switches SWL, SWM, SWR are in the states illustrated in FIGS. 10(*b*), 10(*c*) and 10(*d*). For example, when the main switch status detection means 17*b* detects an "off" state of the main switch SWL as shown in FIG. 10(*b*), the control means 17*c* controls the middle propulsion unit 5M in response to only the position of the lever 14L.

When only the main switch SWR of the propulsion unit 5R is "off" as shown in FIG. 10(*c*), the control means 17*c* controls the middle propulsion unit 5M in response to only the position of the lever 14R. The control through the levers 14L, 14R shown in FIGS. 10(*b*) and 10(*c*) is performed in the same manner as shown in FIGS. 1 and 2.

With the main switch SWL of the propulsion unit 5L and the main switch SWR of the propulsion unit 5R "off" as shown in FIG. 10(*d*), the control means 17*c* controls the middle propulsion unit 5M is response to only one of the levers 14L, 14R. In this embodiment, the middle propulsion unit 5M is controlled so as to respond only to the lever 14L.

The mode of operation through the two remote control levers 14L, 14R is switched when the levers 14L, 14R are in the neutral position.

As described above, when only the main switch SWL of the propulsion unit 5L is "off", the middle propulsion unit 5M is controlled so as to respond only to the lever 14L. When only the main switch SWR of the propulsion unit 5R is off, the middle propulsion unit 5M is controlled so as to respond only to the lever 14R. As a result, if the engine 6 of one of the three propulsion units has a failure and the associated main switch is turned off, the engines 6 of the other two propulsion units can be operated in the same manner as one would operate a boat having two propulsion units.

If the engines 6 of the left and right propulsion units 5L, 5R have a failure and the associated main switches SWL, SWR are turned off, the middle propulsion unit 5M is controlled so as to respond only to one of the levers 14L, 14R. As a result, the boat can be operated in the same manner as one would operate a boat having one propulsion unit. The system enhances operability when getting to the shore, and the like.

When the main switch of any of the propulsion units is turned off, the connection between the control levers and the propulsion units is automatically switched. As a result, if the engine of one of the three propulsion units has a failure and the associated main switch is turned off, the engines of the other two propulsion units can be operated in the same manner as a boat that has two propulsion units. If the engines of two of the three propulsion units fail, the boat can be operated in the same manner as a boat that has one propulsion unit. This provides enhanced operability to get to shore, and the like.

When only the main switch of the left propulsion unit is turned off, the middle propulsion unit responds only to the left lever. When only the main switch of the right propulsion unit is turned off, the middle propulsion unit responds only to the right lever. As a result, if the engine of one of the three propulsion units has a failure and the associated main switch is turned off, the other two propulsion units can be operated in the same manner as in the boat with two propulsion units. When the main switches of the left and right propulsion units are turned off, the middle propulsion unit responds only to either the left lever or the right lever. As a result, if the engines of the left and right propulsion units fail, the boat can be operated in the same manner as a boat with one propulsion unit.

The mode of operation through the remote control levers 14L, 14R is switched when the levers 14L, 14R are at the neutral position in a default mode to prevent abrupt acceleration or deceleration. The following describes the relationship between the two remote control levers 14L, 14R and the movement of the boat 1 in accordance with the embodiment illustrated in FIGS. 1 through 10.

Figures 11A, 11B, 11C, 11D, 11E, 11F:
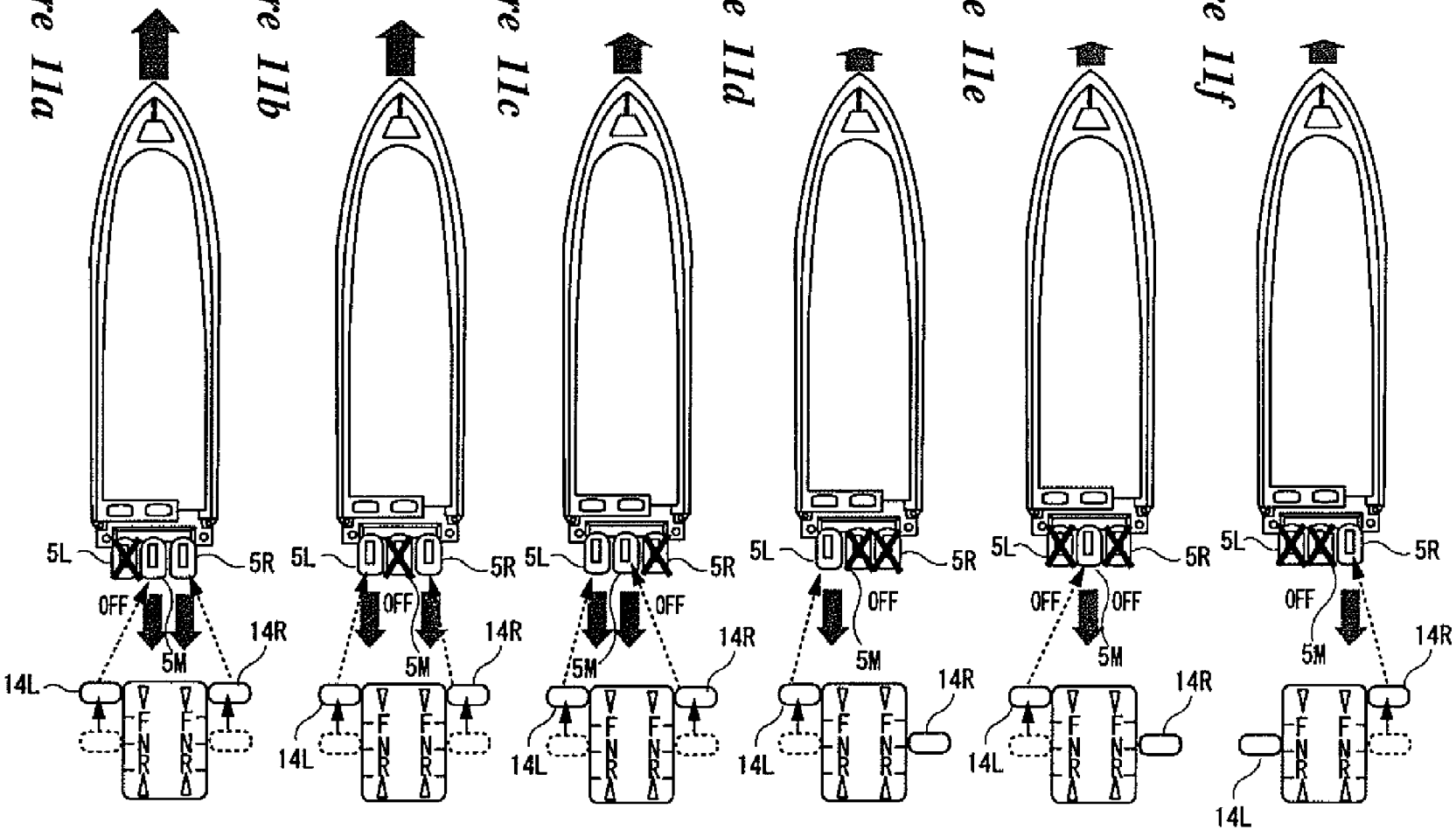
FIGS. 11(*a*) to 11(*f*) illustrate the relationship between the two remote control levers and the movement of the boat when the main switches are "on."

FIGS. 11(*a*) to 11(*f*) illustrate the relationship between the two remote control levers 14L, 14R and the movement of the boat 1 when the main switches SWL, SWM, SWR are "on". In FIG. 11(*a*), with the main switch SWL of the left propulsion unit 5L "off" as shown in FIG. 10(*b*), the levers 14L, 14R are held at the F fully open position. As a result, the boat 1 will be driven forward by maximum propulsion force from the other two propulsion units. In FIG. 11(*b*), with the main switch SWM of the middle propulsion unit 5M "off", the levers 14L, 14R are held at the F fully open position. As a result, the boat 1 will be driven forward by maximum propulsion force from the other two propulsion units.

In FIG. 11(*c*), with the main switch SWR of the right propulsion unit 5R "off" as shown in FIG. 10(*c*), the levers 14L, 14R are held at the F fully open position. As a result, the boat 1 will be driven forward by maximum propulsion force from the other two propulsion units. In FIG. 11(*d*), with the main switches SWM, SWR of the middle and right propulsion units 5M, 5R "off", the lever 14L is held at the F fully open position. As a result, the boat 1 will be driven forward by maximum propulsion force from the other one propulsion unit.

In FIG. 11(*e*), with the main switches SWL, SWR of the left and right propulsion units 5L, 5R "off", the lever 14L is held at the F fully open position. As a result, the boat 1 will be driven forward by maximum propulsion force from the other one propulsion unit. In FIG. 11(*f*), with the main switches SWL, SWM of the left and middle propulsion units 5L, 5M "off", the lever 14R is held at the F fully open position. As a result, the boat 1 will be driven forward by maximum propulsion force from the other one propulsion unit.

Figure 12:
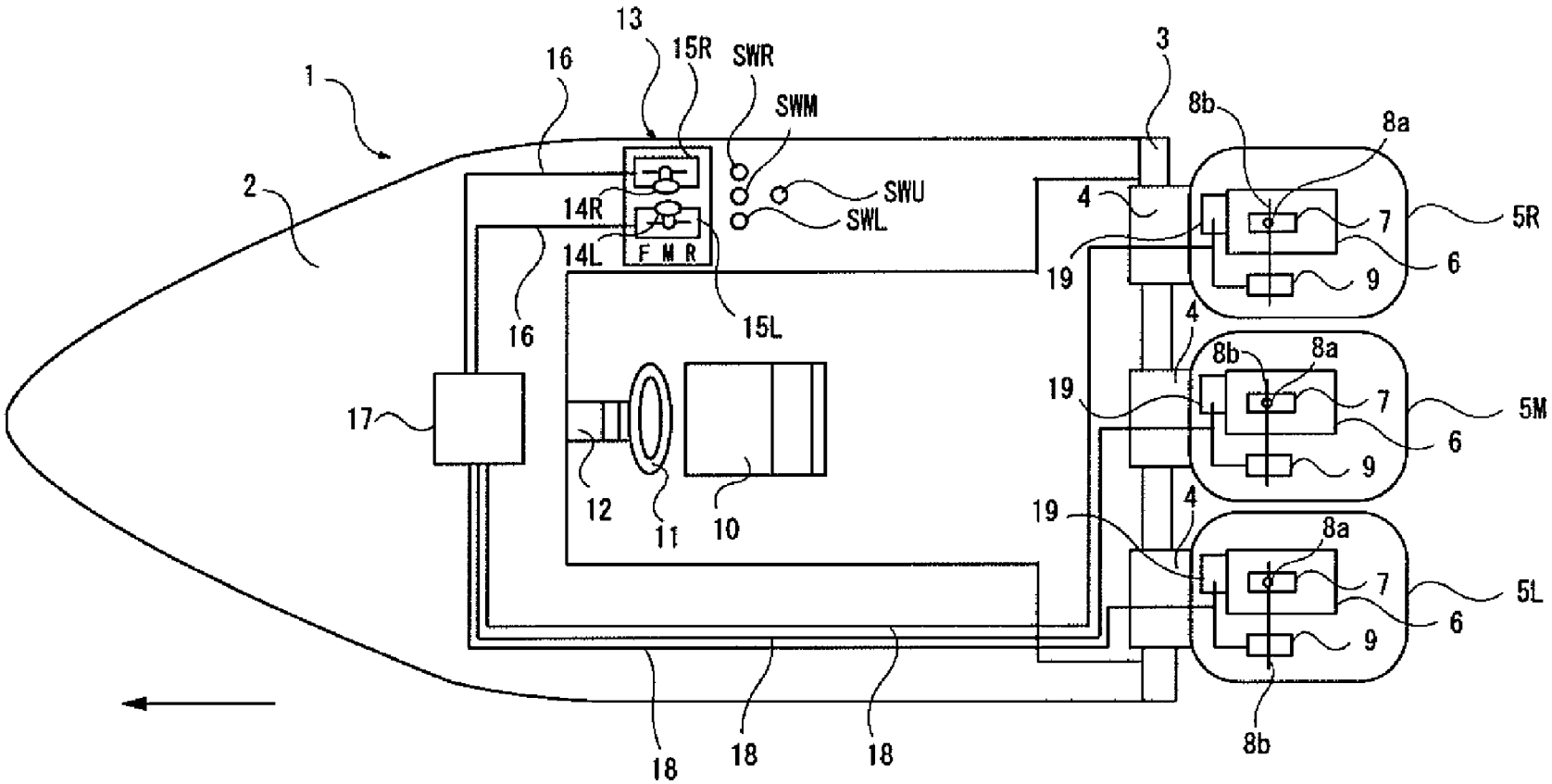
FIG. 12 is a schematic plan view of a boat with a steering system in accordance with another preferred embodiment of the present invention.
Figure 13:
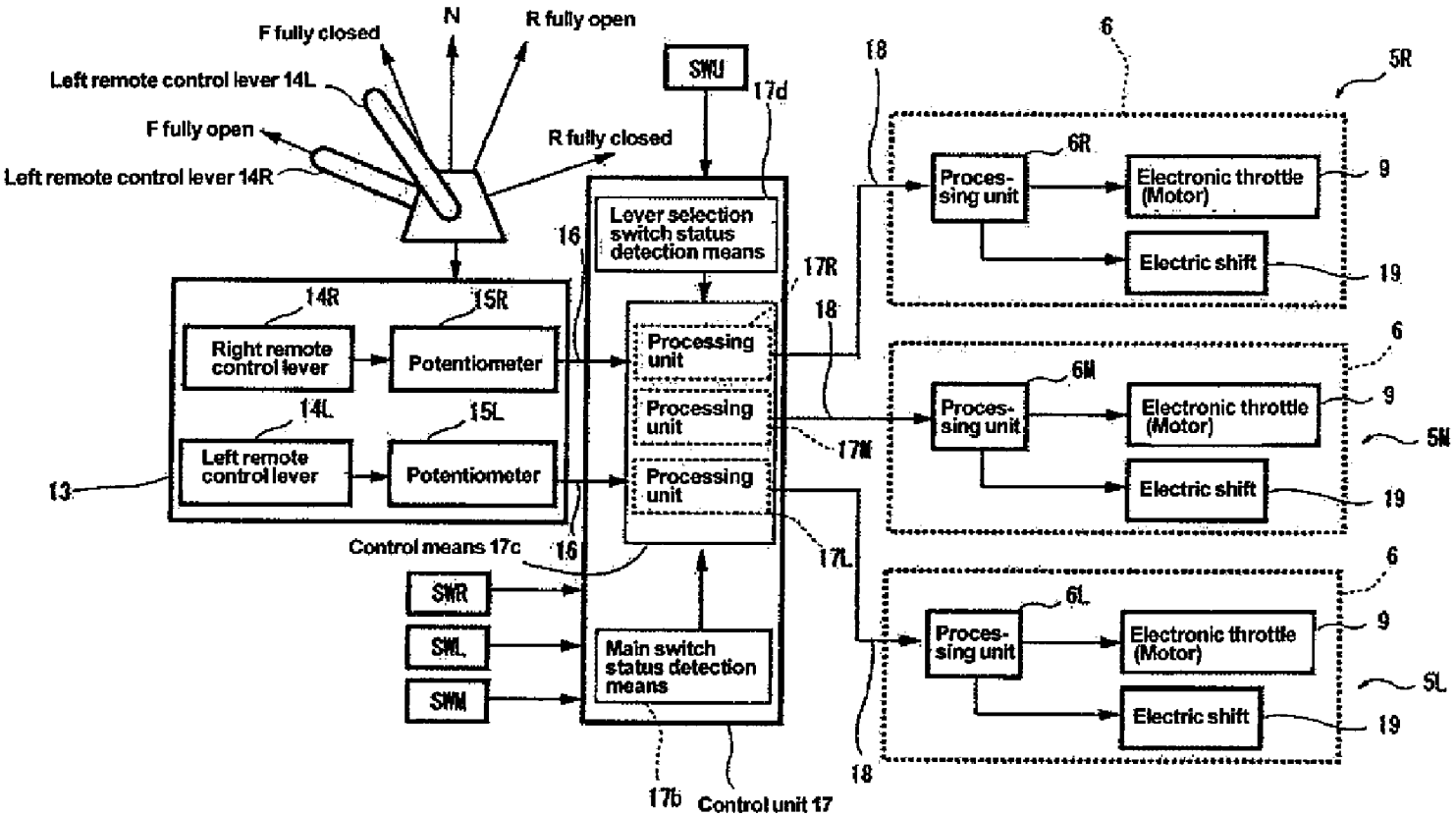
FIG. 13 is a block diagram of the steering system from FIG. 12.
Figure 14:
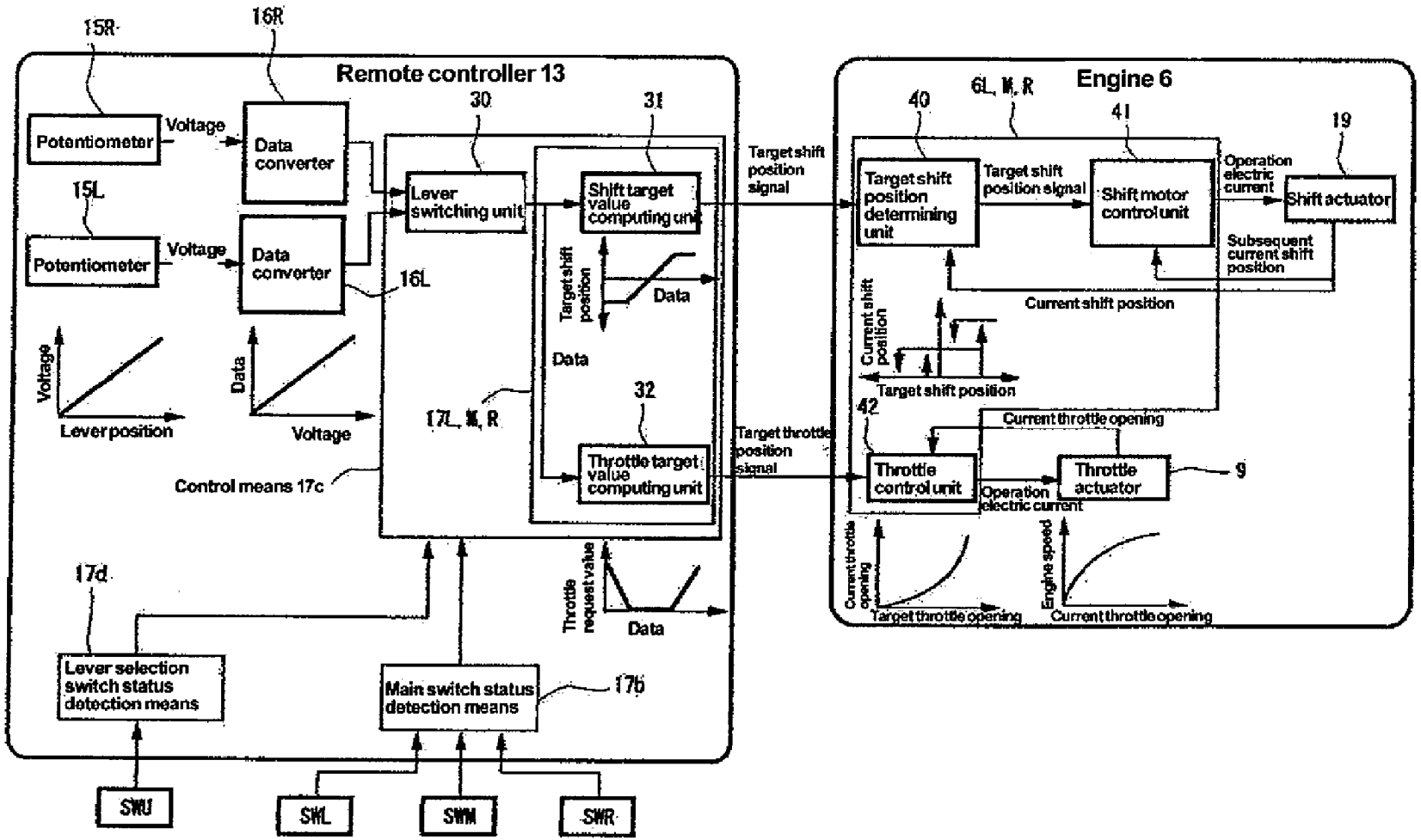
FIG. 14 illustrates a data flow from a remote controller to an engine in accordance with the embodiment illustrated in FIG. 12.

FIGS. 12 through 21 illustrated another preferred embodiment of the present invention. FIG. 12 is a schematic plan view of a boat 1. FIG. 13 is a block diagram of a steering system that includes a remote controller 13, main switches SWL, SWM, SWR, a lever selection switch SWU, a control unit 17, and propulsion units 5L, 5M, 5R. FIG. 14 illustrates a data flow from the remote controller 13 to an engine 6 of the propulsion units 5L, 5M, 5R. The common parts between the embodiments illustrated in FIGS. 1 through 11 and FIGS. 12 through 21 have the same reference numerals. Accordingly, the same description applies to the commonly identified parts.

A lever selection switch SWU is preferably disposed in the vicinity of the main switches SWL, SWM, SWR. The lever selection switch SWU allows the operator to select the modes of operation through the two control levers. With the main switches SWL, SWM, SWR "on", operation of the lever selection switch SWU switches the operation mode. In this mode a lever switching control as was discussed with respect to the embodiment illustrated in FIGS. 1 to 11 will not occur in response to operation of the main switches SWL, SWM, SWR. When one or two of the main switches SWL, SWM, SWR are turned off, the lever switching control as discussed with respect to FIGS. 1 to 11 will precede the switching of the operation mode in response to the operation of the lever selection switch SWU.

As shown in FIGS. 12 to 15(*a*), 15(*b*) and 15(*c*), the remote controller 13 includes lever selection switch status detection means 17*d*. The lever selection switch status detection means 17*d* detects an operation status of the lever selection switch SWU. The control means 17*c* adjusts the boat steering system in response to the detected status of the lever selection switch SWU. The control means 17*c* cycles through the modes of operating the propulsion units 5L, 5M, 5R depending on the positions of the remote control levers 14L, 14R and whether the lever selection switch SWU is switched between a released/off state and a pressed/on state.

Figures 15A, 15B, 15C:
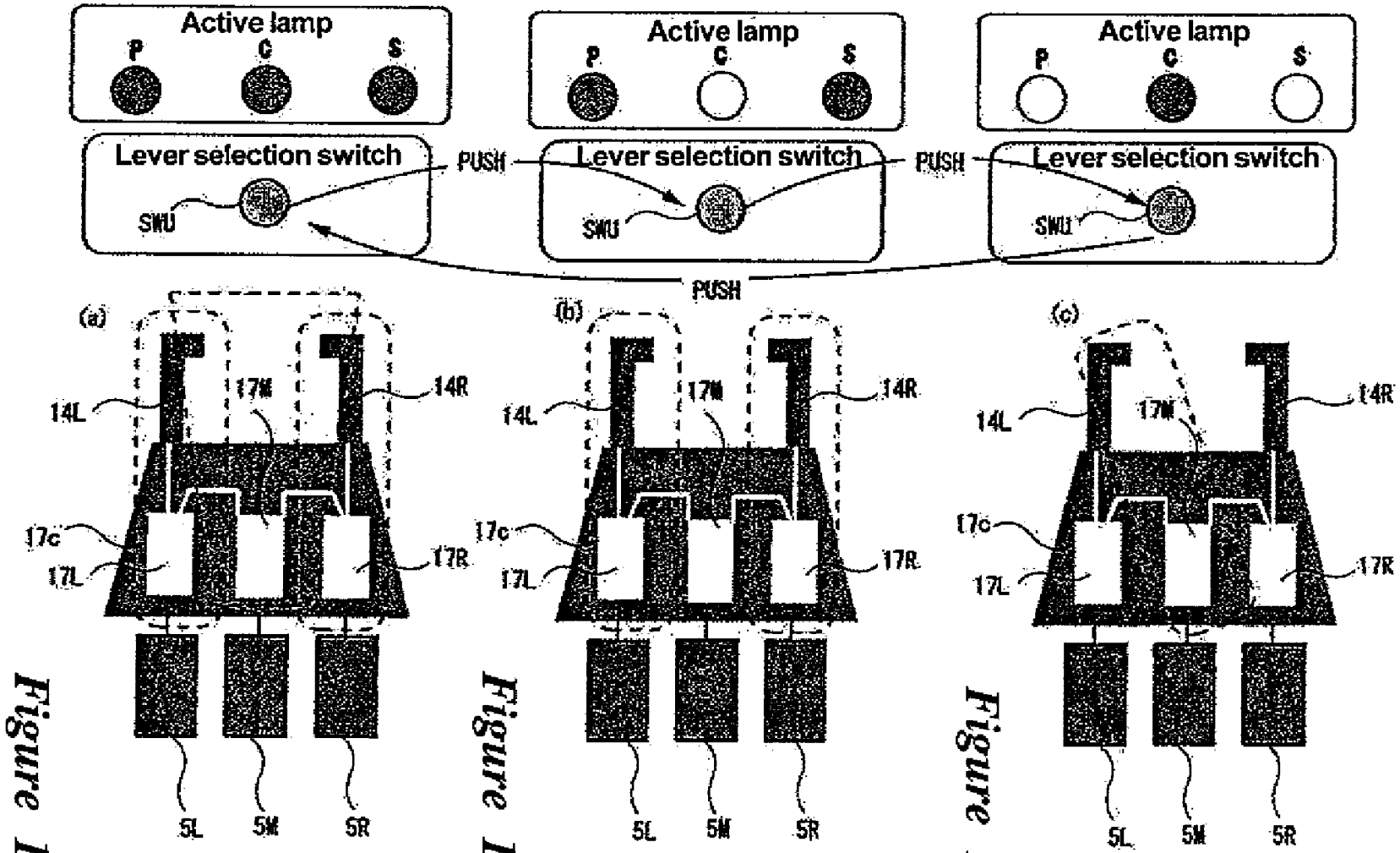
FIGS. 15(*a*), 15(*b*) and 15(*c*) illustrate a method of changing how the control levers control the propulsion units by activating a lever selection switch.

For example, as shown in FIG. 15(*a*), when the lever selection switch SWU is released, the lever selection switch status detection means 17*d* detects the released state of the switch SWU as shown in FIGS. 12 and 13. In the released state, the control means 17*c* does not switch the control mode of the engines of the propulsion units 5L, 5M, 5R, but instead controls the propulsion units 5L, 5M, 5R as described above with respect to FIGS. 1 to 11.

As shown in FIG. 15(*b*), when the lever selection switch SWU is pressed, the lever selection switch status detection means 17*d* detects the pressed state of the switch SWU as shown in FIGS. 12 and 13. Since the lever selection switch SWU is pressed, the control means 17*c* makes only the left and right propulsion units operable. More specifically, the control means 17*c* switches the control mode from a first mode in which the three propulsion units 5L, 5M, 5R are operable through the two levers 14L, 14R as shown in FIG. 15(*a*) to a second mode in which only the two propulsion units 5L, 5R are operable and the middle propulsion unit 5M is held at the neutral position.

As shown in FIG. 15(*c*), when the lever selection switch SWU is pressed again, the lever selection switch status detection means 17*d* detects the pressed state of the switch SWU as shown in FIGS. 12 and 13. Since the lever selection switch SWU is pressed again, the control means 17*c* switches the control mode to a third mode in which the left and right propulsion units 5L, 5R are held at the neutral position and the middle propulsion unit 5M is operable through one of the levers 14L, 14R. Of course the order of the operational modes could be reversed.

As described above, each time the lever selection switch SWU is operated, the control mode is sequentially switched from a first mode in which the three propulsion units 5L, 5M, 5R are operable through the two levers 14L, 14R to a second mode in which only the left and right propulsion units 5L, 5R are operable and the middle propulsion unit 5M is held at the neutral position. As a result, the boat can advance at very slow speed with the left and right propulsion units in a shift-in state. Further, the control mode can be switched to a third control mode in which only the middle propulsion unit 5M is operable through one of the levers 14L, 14R and the other two propulsion units 5L, 5R are held at the neutral position. As a result, the boat can advance at an even slower speed with only the middle propulsion unit 5M in a shift-in state through the operator's simple operation of the switch.

Discussion will now be given to the relationship between the two remote control levers 14L, 14R and the movement of the boat 1 in accordance with the embodiment illustrated in FIGS. 12 through 21.

Figures 16A, 16B, 16C, 16D, 16E, 16F:
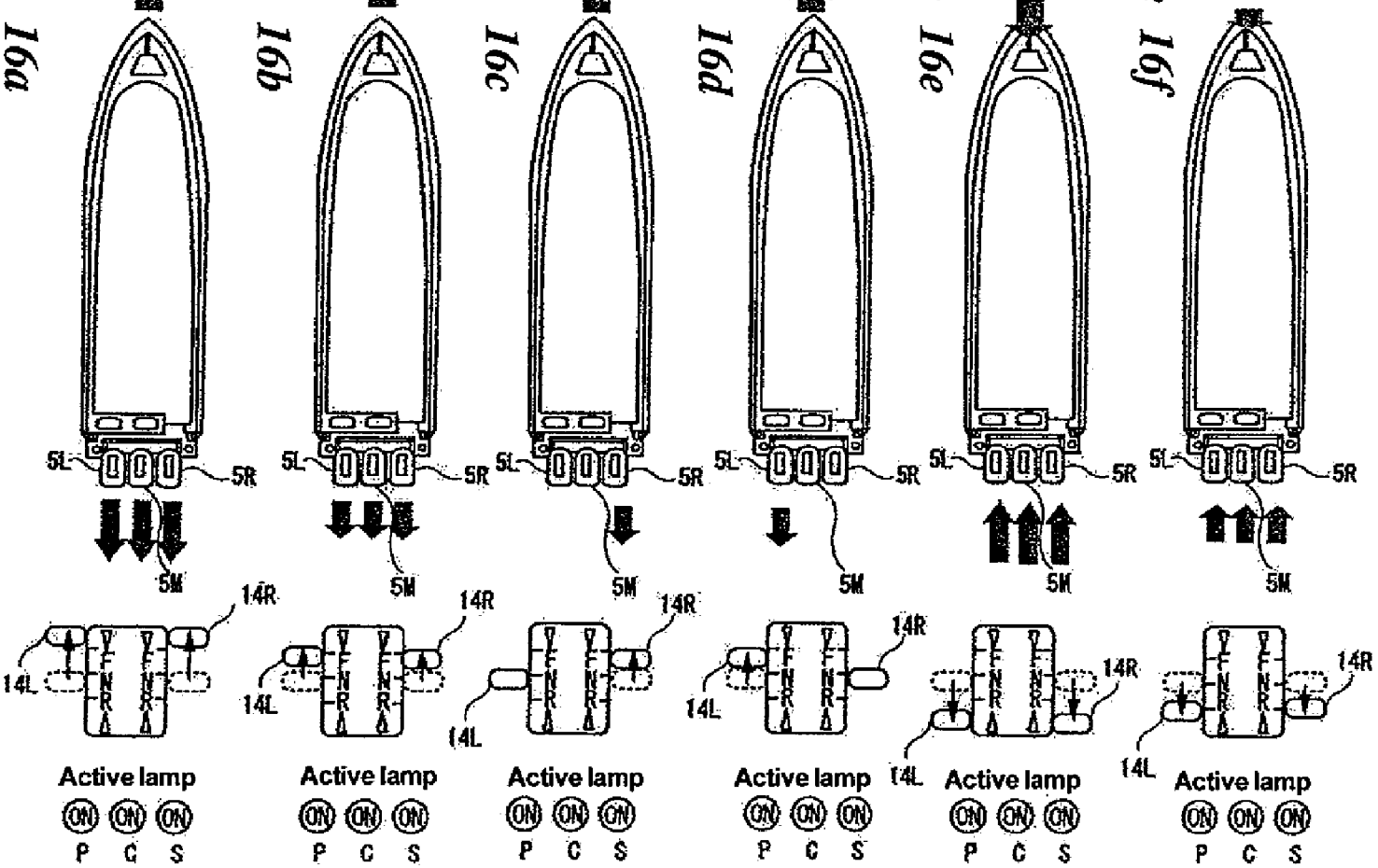
FIGS. 16(*a*) to 16(*f*) illustrate the relationship between the positions of the two remote control levers and the movement of the boat in accordance with the embodiment illustrated in FIG. 12.

FIGS. 16(*a*) to 16(*f*) illustrate the relationship between the positions of the remote control levers 14L, 14R and the movement of the boat 1 when the lever selection switch is in a default mode as shown in FIG. 15(*a*). In FIG. 16(*a*), with the two levers 14L, 14R at the F fully open position, the boat is driven forward by maximum propulsion force from the three propulsion units 5L, 5M, 5R. In FIG. 16(*b*), with the two levers 14L, 14R at the F fully closed position, the boat is driven forward by a smaller propulsion force from the three propulsion units 5L, 5M, 5R than as shown in FIG. 16(*a*). In FIG. 16(*c*), with only the lever 14R at the F fully closed position, the boat is driven forward by a propulsion force from one propulsion unit 5R that is smaller than the propulsion force achieved in FIG. 16(*b*). In FIG. 16(*d*), with only the lever 14L at the F fully closed position, the boat is driven forward by a smaller propulsion force from one propulsion unit than the propulsion force achieved in FIG. 16(*c*). In FIG. 16(*e*), with the two levers 14L, 14R at the R fully open position, the boat is driven in reverse by maximum propulsion force from three propulsion units 5L, 5M, 5R. In FIG. 16(*f*), with the two levers 14L, 14R at the R fully closed position, the boat is driven in reverse by smaller propulsion force from three propulsion units 5L, 5M, 5R than as shown in FIG. 16(*e*). As such, the propulsion force for the boat can be varied when the operator operates the remote control levers 14L, 14R.

Figures 17A, 17B, 17C, 17D, 17E, 17F:
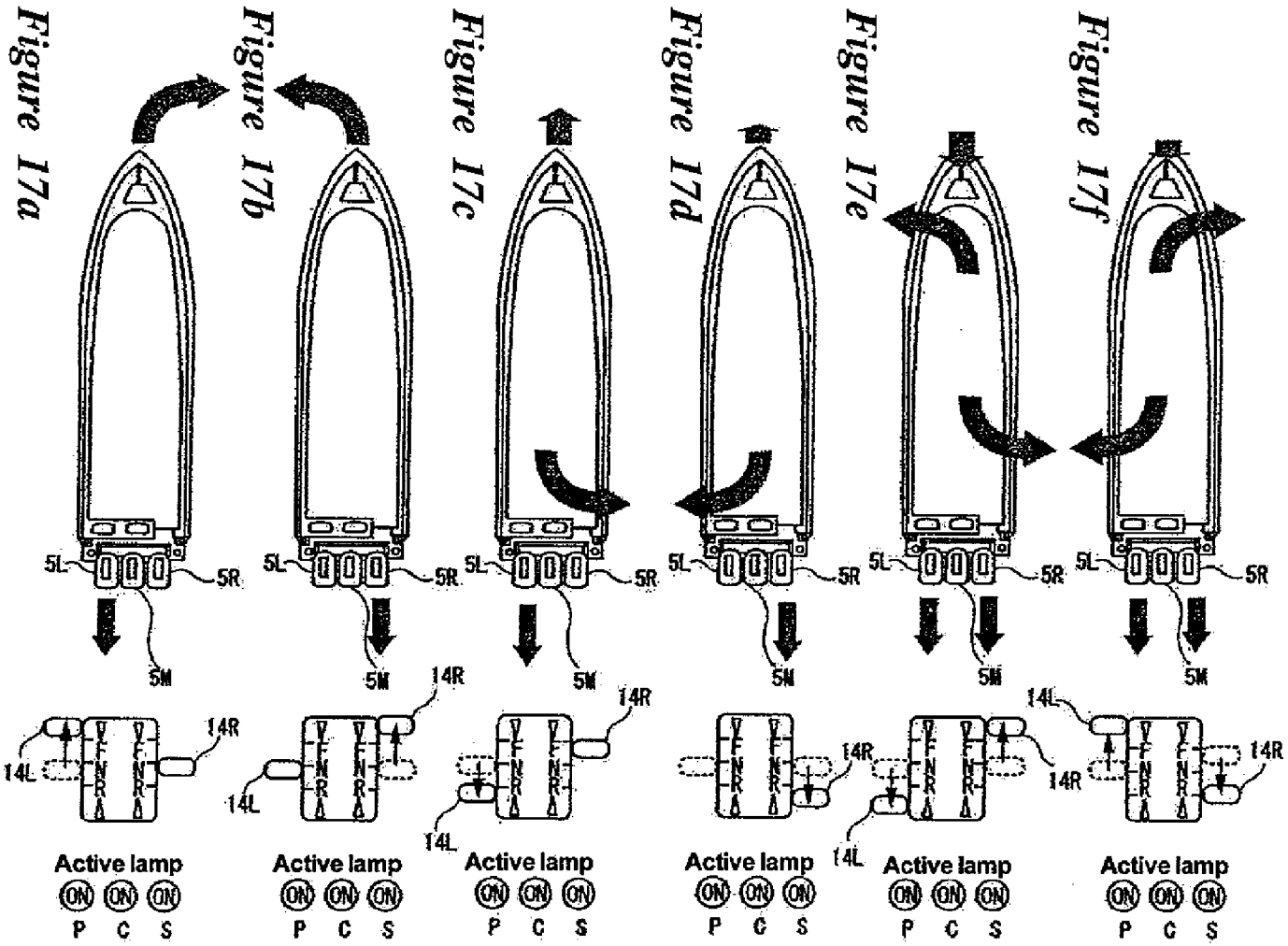
FIGS. 17(*a*) to 17(*f*) illustrate the relationship between the positions of the two remote control levers and the movement of the boat when the lever selection switch is in a default mode as shown in FIG. 15(*a*).

FIGS. 17(*a*) to 17(*f*) illustrate the relationship between the remote control levers 14L, 14R and the movement of the boat 1 when the lever selection switch is in a default mode as shown in FIG. 15(*a*). In FIG. 17(*a*), with the lever 14L at the F fully open position and the lever 14R at the neutral position, the boat is turned to the right during advancing by maximum propulsion force from a left propulsion unit. In FIG. 17(*b*), with the lever 14R at the F fully open position and the lever 14L at the neutral position, the boat is turned to the left during advancing by maximum propulsion force from a right propulsion unit. In FIG. 17(*c*), with only the lever 14L at the R fully open position, the boat is turned to the left during reverse running by propulsion force from a left propulsion unit. In FIG. 17(*d*), with only the lever 14R at the R fully open position, the boat is turned to the right during reverse running by propulsion force from one propulsion unit. In FIG. 17(*e*), with the lever 14L at the R fully open position and the lever 14R at the F fully open position, the boat is turned to the left by maximum propulsion force from left and right propulsion units. In FIG. 17(*f*), with the lever 14L at the F fully open position and the lever 14R at the R fully open position, the boat is turned to the right by maximum propulsion force from left and right propulsion units.

Figures 18A, 18B, 18C, 18D, 18E, 18F:
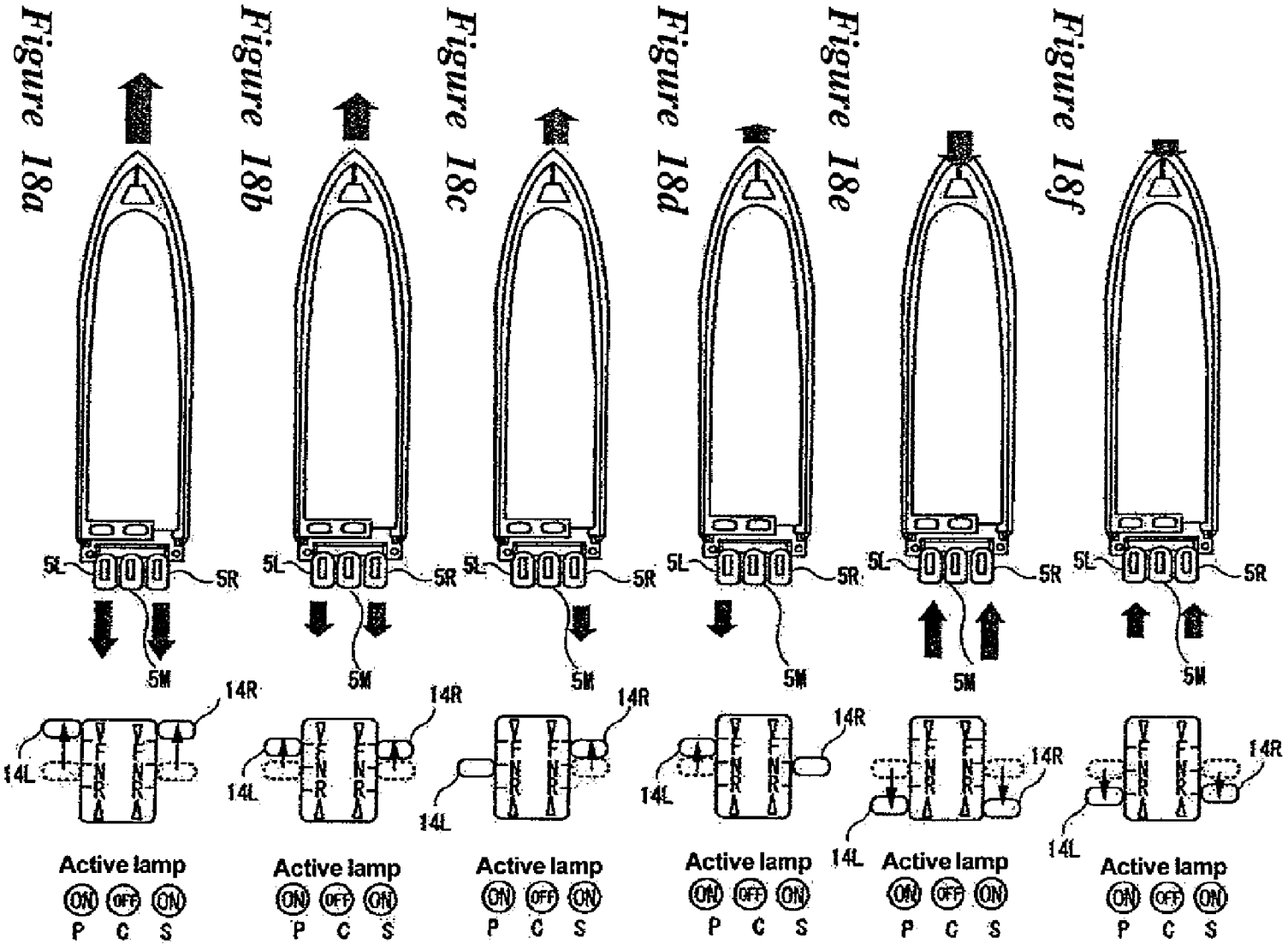
FIGS. 18(*a*) to 18(*f*) illustrate the relationship between the positions of the two remote control levers and the movement of the boat when the lever selection switch is set so that two propulsion units are in operation as shown in FIG. 15(*b*).

FIGS. 18(*a*) to 18(*f*) illustrate the relationship between the remote control levers 14L, 14R and the movement of the boat 1 when the lever selection switch is set so that two propulsion units are in operation as shown in FIG. 15(*b*). In FIG. 18(*a*), with the two levers 14L, 14R at the F fully open position, the boat is driven forward by a maximum propulsion force from the left and right propulsion units. In FIG. 18(*b*), with the two levers 14L, 14R at the F fully closed position, the boat is driven forward by a smaller propulsion force from the left and right propulsion units than as shown in FIG. 18(*a*). In FIG. 18(*c*), with only the lever 14R at the F fully closed position, the boat is driven forward by a smaller propulsion force from a right propulsion unit than as shown in FIG. 18(*b*). In FIG. 18(*d*), with only the lever 14L at the F fully closed position, the boat is driven forward by a smaller propulsion force from a left propulsion unit than as shown in FIG. 18(*c*). In FIG. 18(*e*), with the two levers 14L, 14R at the R fully open position, the boat is driven in reverse by a maximum propulsion force from left and right propulsion units. In FIG. 18(*f*), with the two levers 14L, 14R at the R fully closed position, the boat is driven in reverse by a smaller propulsion force from left and right propulsion units than as shown in FIG. 18(*e*). As such, the operator's operation of the remote control operation levers 14L, 14R varies the propulsion force applied to the boat.

Figures 19A, 19B, 19C, 19D, 19E, 19F:
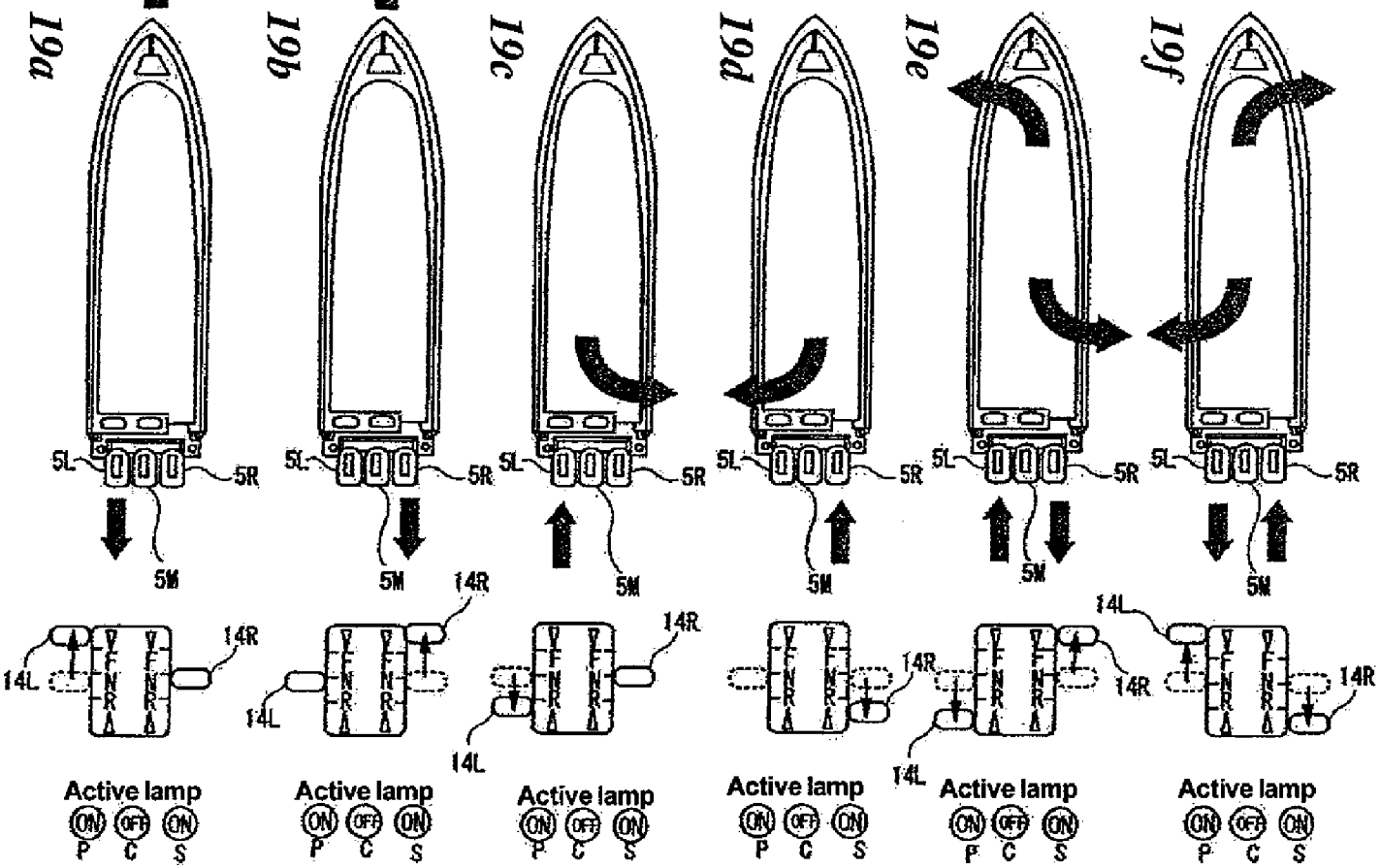
FIGS. 19(*a*) to 19(*f*) illustrate the relationship between the positions of the two remote control levers and the movement of the boat when the lever selection switch is set so that two propulsion units are in operation as shown in FIG. 15(*b*).

FIGS. 19(*a*) to 19(*f*) illustrate the relationship between the remote control levers 14L, 14R and the movement of the boat 1 when the lever selection switch is set so that two propulsion units are in operation as shown in FIG. 15(*b*). In FIG. 19(*a*), with the lever 14L at the F fully open position and the lever 14R at the neutral position, the boat is turned to the right when advancing by a maximum propulsion force from the left propulsion unit. In FIG. 19(*b*), with the lever 14R at the F fully open position and the lever 14L at the neutral position, the boat is turned to the left when advancing by a maximum propulsion force from a right propulsion unit. In FIG. 19(*c*), with only the lever 14L at the R fully open position, the boat is turned to the left during reverse driving by a propulsion force from a left propulsion unit. In FIG. 19(*d*), with only the lever 14R at the R fully open position, the boat is turned to the left during reverse driving by propulsion force from one propulsion unit. In FIG. 19(*e*), with the lever 14L at the R fully open position and the lever 14R at the F fully open position, the boat is turned to the left by a maximum propulsion force from left and right propulsion units. In FIG. 19(*f*), with the lever 14L at the F fully open position and the lever 14R at the R fully open position, the boat is turned to the right by a maximum propulsion force from left and right propulsion units. As such, the operator's operation of the remote control operation levers 14L, 14R varies the propulsion force applied to the boat.

Figures 20A, 20B, 20C, 20D, 20E, 20F:
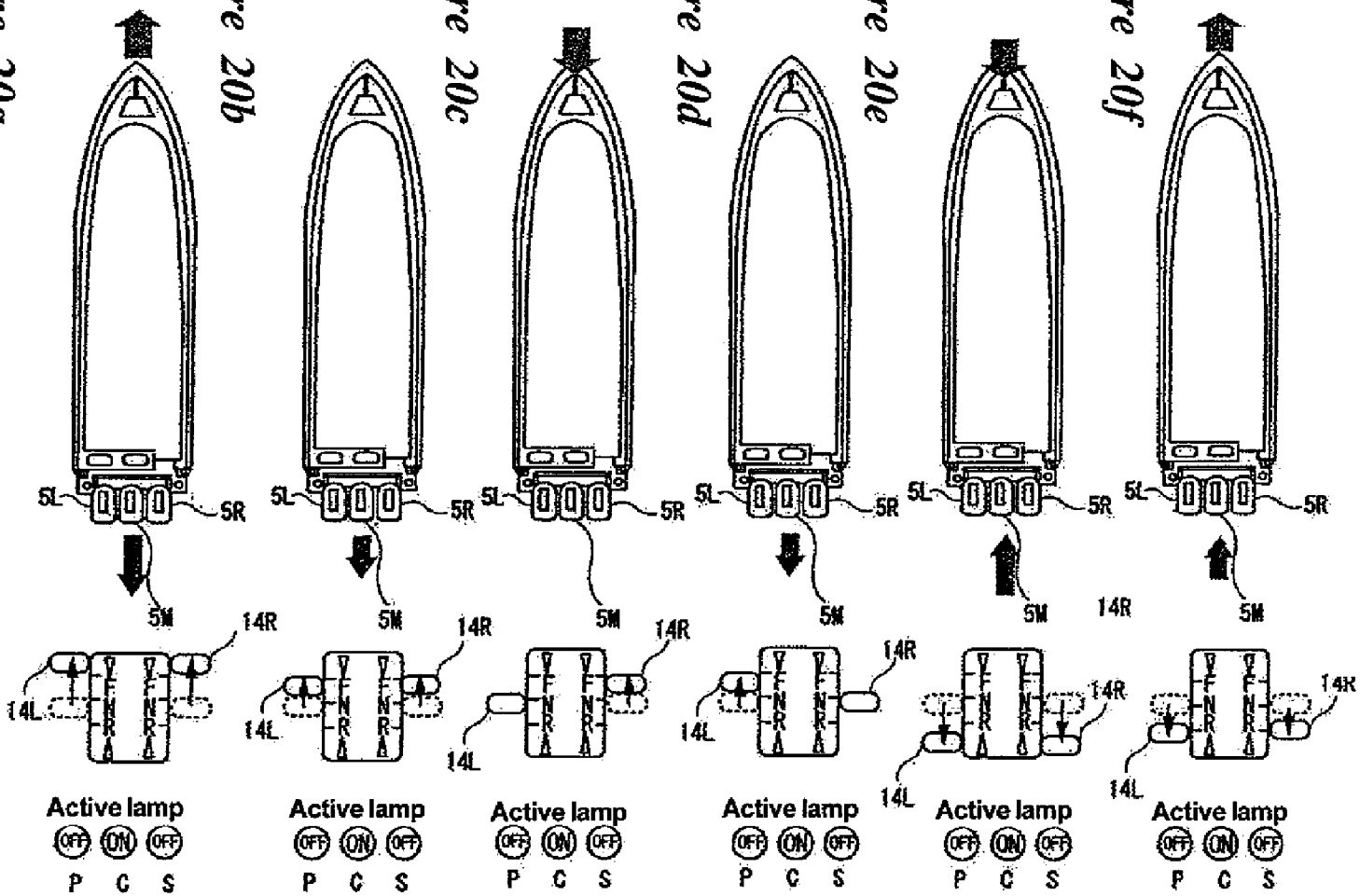
FIGS. 20(*a*) to 20(*f*) illustrate the relationship between the positions of the two remote control levers and the movement of the boat when the lever selection switch is set so that the middle propulsion unit is in operation as shown in FIG. 15(*c*).

FIGS. 20(*a*) to 20(*f*) illustrate the relationship between the remote control levers 14L, 14R and the movement of the boat 1 when the lever selection switch is set so that the middle propulsion unit is in operation as shown in FIG. 15(*c*). In FIG. 20(*a*), with the two levers 14L, 14R at the F fully open position, the boat is driven forward by a maximum propulsion force from one propulsion unit. In FIG. 20(*b*), with the two levers 14L, 14R at the F fully closed position, the boat is driven forward by a smaller propulsion force from one propulsion unit than as shown in FIG. 20(*a*). In FIG. 20(*c*), with only the lever 14R at the F fully closed position, the boat does not advance since there is no propulsion force from the operating propulsion unit. In FIG. 20(*d*), with only the lever 14L at the F fully closed position, the boat is driven forward by the same amount of propulsion force from one propulsion unit as achieved in FIG. 20(*b*). In FIG. 20(*e*), with the two levers 14L, 14R at the R fully open position, the boat is driven in reverse by maximum propulsion force from one propulsion unit. In FIG. 20(*f*), with the two levers 14L, 14R at the R fully closed position, the boat is driven in reverse by a smaller propulsion force from one propulsion unit than as shown in FIG. 20(*e*). As such, the operator's operation of the remote control operation levers 14L, 14R varies the propulsion force applied to the boat.

Figures 21A, 21B, 21C, 21D, 21E, 21F:
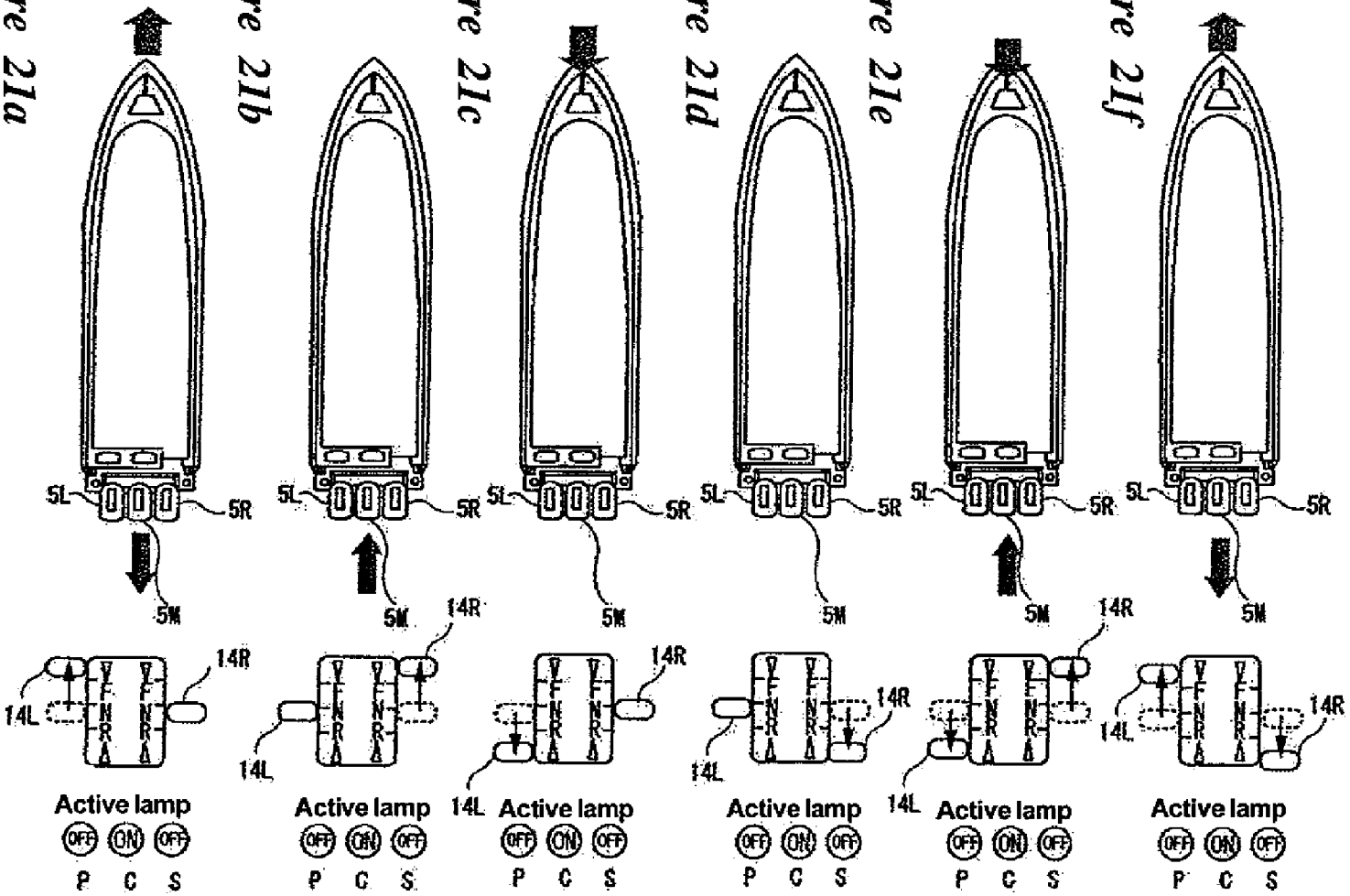
FIGS. 21(*a*) to 21(*f*) illustrate the relationship between the positions of the two remote control levers and the movement of the boat when the lever selection switch is set so that the middle propulsion unit is in operation as shown in FIG. 15(*c*).

FIGS. 21(*a*) to 21(*f*) illustrate the relationship between the remote control levers 14L, 14R and the movement of the boat 1 when the lever selection switch is set so that the middle propulsion unit is in operation as shown in FIG. 15(*c*). In FIG. 21(*a*), with the lever 14L at the F fully open position and the lever 14R at the neutral position, the boat turns to the right when advancing by a maximum propulsion force from a left propulsion unit. In FIG. 21(*b*), with the lever 14R at the F fully open position and the lever 14L at the neutral position, the boat is not propelled. In FIG. 21(*c*), with only the lever 14L at the R fully open position, the boat is driven in reverse by a propulsion force from one propulsion unit. In FIG. 21(*d*), with only the lever 14R at the R fully open position, the boat is not propelled. In FIG. 21(*e*), with the lever 14L at the R fully open position and the lever 14R at the F fully open position, the boat is driven in reverse by propulsion force from one propulsion unit. In FIG. 21(*f*), with the lever 14L at the F fully open position and the lever 14R at the R fully open position, the boat is driven forward by a maximum propulsion force from one propulsion unit. As such, the operator's operation of the remote control operation levers 14L, 14R varies the propulsion force applied to the boat.

In this embodiment, each time the lever selection switch SWU is operated, the control mode is sequentially switched from a first mode in which the three propulsion units 5L, 5M, 5R are operable through the two levers 14L, 14R to a second mode in which only the left and right propulsion units 5L, 5R are operable and the middle propulsion unit 5M is held at the neutral position. As a result, the boat can advance at very slow speed with the left and right propulsion units in a shift-in state. Further, the control mode can be switched to a third control mode in which only the middle propulsion unit 5M is operable through one of the levers 14L, 14R and the other two propulsion units 5L, 5R are held at the neutral position. As a result, the boat can advance at an even slower speed with only the middle propulsion unit 5M in a shift-in state through operator's simple operation of the switch.

The lever selection switch SWU is preferably only operable when all the main switches SWL, SWM, SWR are "on" and the two remote control levers 14L, 14R are at the neutral position. As a result, there is no fear of abrupt acceleration or deceleration of the boat due to lever switching control. The lever selection switch SWU can be employed in addition to the lever switching function based on operator's operation of the main switches of the left and right propulsion units 5L, 5R.

Figures 22A, 22B:
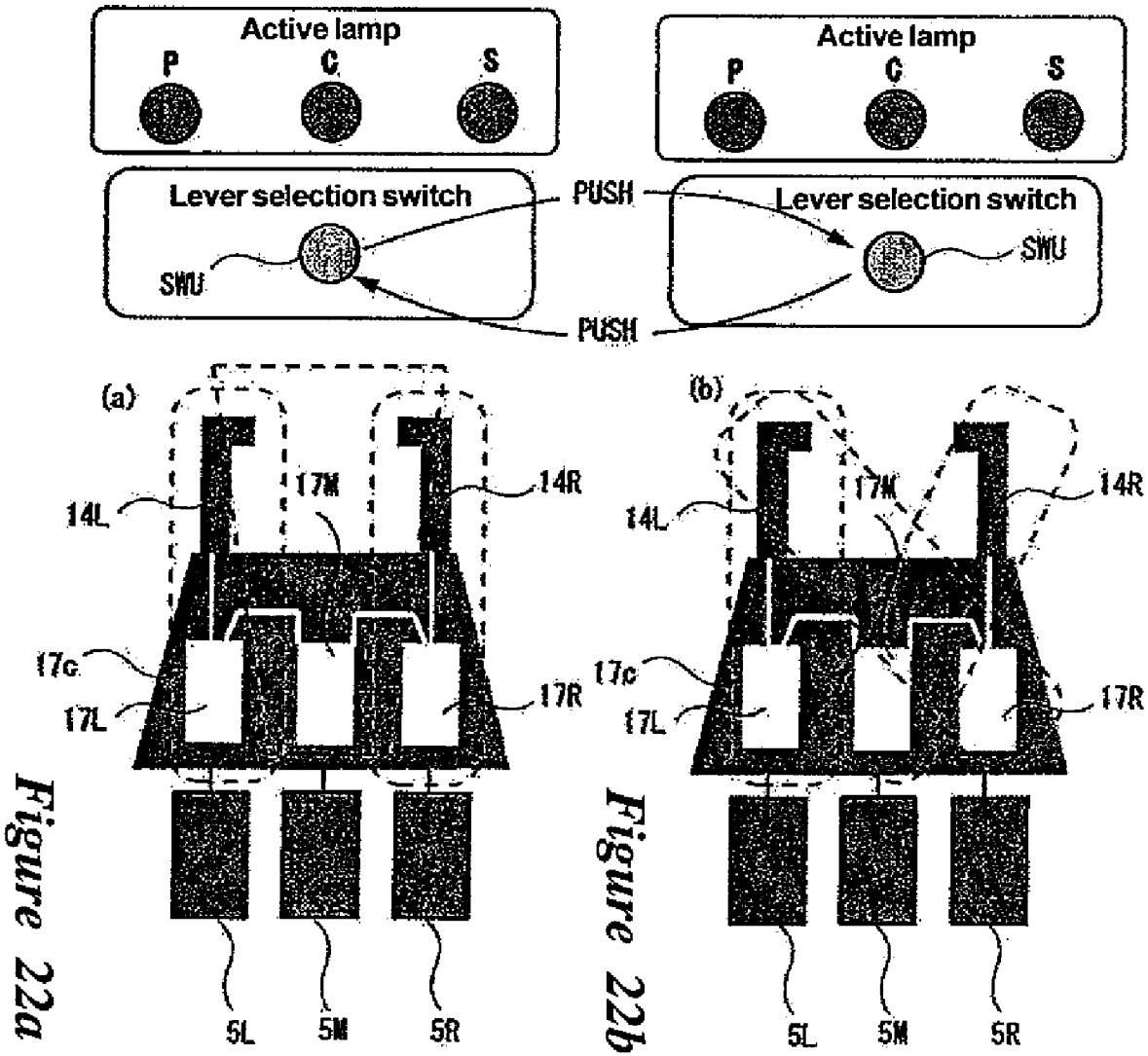
FIGS. 22(*a*) and 22(*b*) illustrate a method of changing how the control levers control the propulsion units by activating a lever selection switch in accordance with another preferred embodiment of the present invention.
Figures 23A, 23B, 23C, 23D, 23E, 23F:
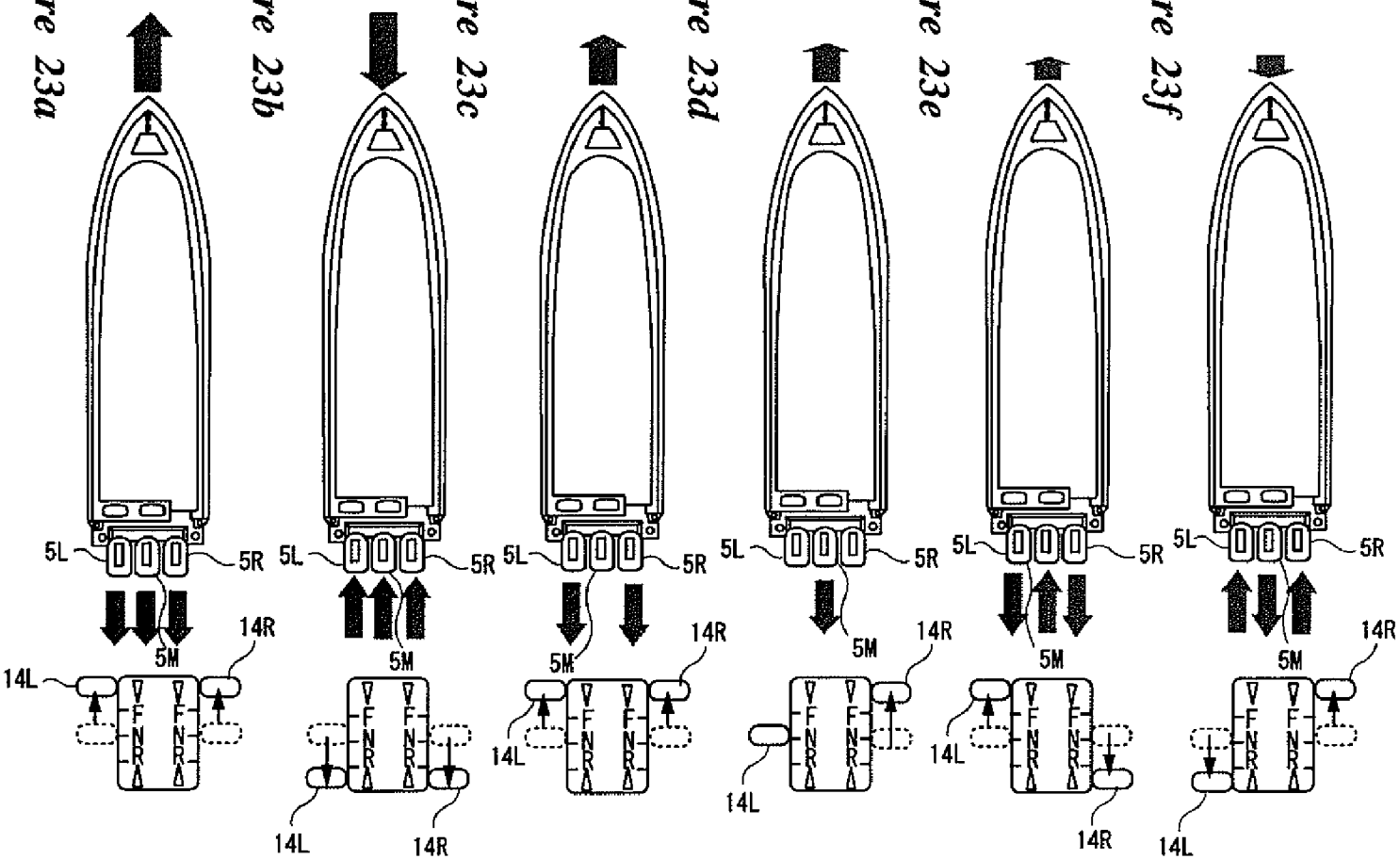
FIGS. 23(*a*) to 23(*f*) illustrate the relationship between the positions of the two remote control levers and the movement of a boat in accordance with the embodiment illustrated in FIGS. 22(*a*) and 22(*b*).

FIGS. 22 through 23 illustrated another preferred embodiment of the present invention. FIGS. 22(*a*) and 22(*b*) illustrate a method of changing how the control levers control the propulsion units by activating a lever selection switch in accordance with another preferred embodiment of the present invention. The common parts between the embodiments illustrated in FIGS. 1 through 11 and FIGS. 22 through 23 have the same reference numerals. Accordingly, the same description applies to the commonly identified parts.

The embodiment illustrated in FIGS. 22 through 23 includes a lever selection switch SWU. The lever selection switch SWU allows the operator to select the mode of operation for the two control levers. With the main switches SWL, SWM, SWR "on", when the lever selection switch SWU is operated, the operation mode will be switched. The lever switching control described with reference to FIGS. 1 through 11 that occurs in response to the operation of the main switches SWL, SWM, SWR does not occur with respect to this embodiment.

The control means 17*c* cycles through the modes of operation for the propulsion units 5L, 5M, 5R each time the lever selection switch SWU is pressed. For example, as shown in FIG. 22(*a*), when the lever selection switch SWU is released, the lever selection switch status detection means 17*d* detects the released state of the switch SWU as shown in FIGS. 12 and 13. In this state, the control means 17*c* does not switch the control mode of the engines of the propulsion units 5L, 5M, 5R, but controls the propulsion units 5L, 5M, 5R as shown in FIGS. 1 to 11.

As shown in FIG. 22(*b*), when the lever selection switch SWU is pressed, the lever selection switch status detection means 17*d* detects the pressed state of the switch SWU as shown in FIGS. 12 and 13. Since the lever selection switch SWU is pressed, the control means 17*c* makes the left propulsion unit 5L and the right propulsion unit 5R operable through the lever 14L and makes the middle propulsion unit 5M operable through the lever 14R. More specifically, the control means 17*c* switches the control mode from a first mode in which the three propulsion units 5L, 5M, 5R are operable through the two levers 14L, 14R as shown in FIG. 22(*a*) to a second mode in which only the two propulsion units 5L, 5R are operable and the middle propulsion unit 5M is held at the neutral position. The lever selection switch SWU is only operable when all the main switches SWL, SWM, SWR are "on" and the two remote control levers 14L, 14R are at the neutral position.

When the lever selection switch SWU is pressed again, the lever selection switch status detection means 17*d* detects the pressed state of the switch SWU as shown in FIGS. 12 and 13. Since the lever selection switch SWU is pressed again, the control means 17*c* switches the control mode to the first mode in which the propulsion units 5L, 5M, 5R are operable through the levers 14L, 14R as shown in FIG. 22(*a*).

As described above, each time the lever selection switch SWU is operated, the control mode switches between the first mode in which the three propulsion units 5L, 5M, 5R are operable through the two levers 14L, 14R to the second mode in which the left and right propulsion units 5L, 5R are operable through the lever 14L and the middle propulsion unit 5M is operable through the lever 14R. As a result, the boat can be driven with the left and right propulsion units 5L, 5R in the forward mode and the middle propulsion unit 5M in the reverse mode. At this time, when engine speeds of the propulsion units are controlled through the two levers 14L, 14R, the boat can be driven continuously at a very low speeds between a trolling mode and a standing mode.

The lever selection switch SWU is preferably only operable when all the main switches SWL, SWM, SWR are "on" and the two remote control levers 14L, 14R are at the neutral position. As a result, there is no fear of abrupt acceleration or deceleration of the boat due to lever switching control. The lever selection switch SWU can be employed in addition to the lever switching function based on operator's operation of the main switches of the left and right propulsion units 5L, 5R.

Discussion will now be given to the relationship between the two remote control levers 14L, 14R and the movement of the boat 1. In a default mode, when the levers 14L, 14R are held at the F fully open position, the boat is driven forward by maximum propulsion force from the three propulsion units. When the levers 14L, 14R are held at the R fully open position, the boat is driven in reverse by maximum propulsion force from the three propulsion units.

As shown in FIG. 23(*a*), when the two levers 14L, 14R are held at the F fully open position, the boat is driven forward by a maximum propulsion force from three propulsion units. As shown in FIG. 23(*b*), when the two levers 14L, 14R are held at the R fully open position, the boat is driven in reverse by a maximum propulsion force from three propulsion units. As shown in FIG. 23(*c*), when the two levers 14L, 14R are held at the F fully open position, the boat is driven forward by a propulsion force from two propulsion units. As shown in FIG. 23(*d*), when the lever 14R is held at the F fully open position, the boat is driven forward by a propulsion force from one propulsion unit. As shown in FIG. 23(*e*), when the lever 14L is held at the F fully open position and the lever 14R is held at the R fully open position, the boat is driven forward by a propulsion force from two propulsion units and a reverse propulsion force from one propulsion unit. As shown in FIG. 23(*f*), when the lever 14L is held at the R fully open position and the lever 14R is held at the F fully open position, the boat is driven in reverse by a reverse propulsion force from two propulsion units and a forward propulsion force from one propulsion unit.

Figure 24:
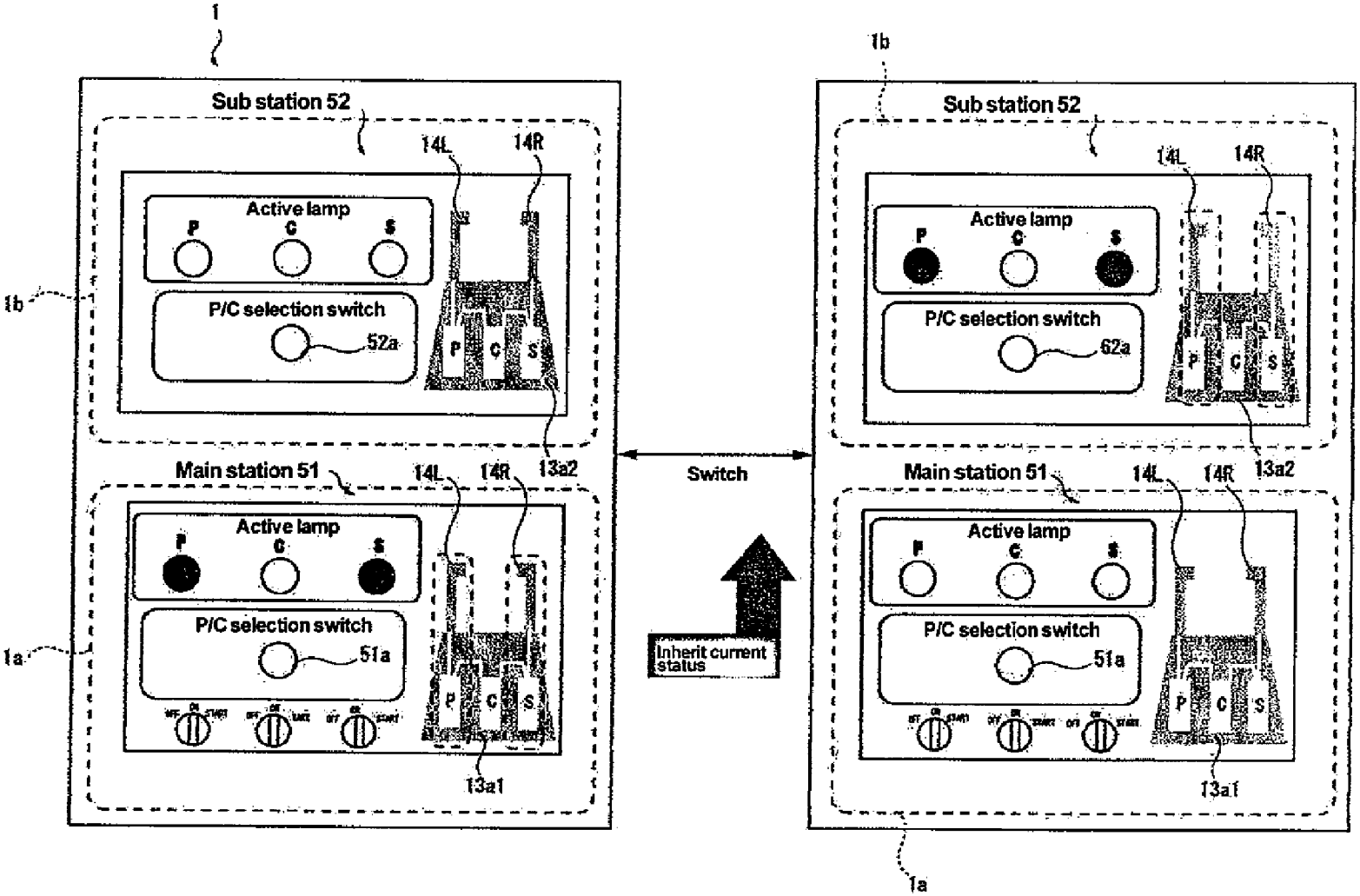
FIG. 24 illustrates a method of switching control of the propulsion units between a sub station and a main station in accordance with still another preferred embodiment of the present invention.

FIG. 24 illustrates a method of switching control of the propulsion units between a sub station and a main station in accordance with still another preferred embodiment of the present invention. In this embodiment, the boat 1 has two stages, a first stage 1*a* and a second stage 1*b*. In the first stage 1*a*, a main station 51 includes two remote control levers 14L, 14R. In the second stage 1*b*, a sub station 52 includes two remote control levers 14L, 14R. The main station 51 also includes a remote controller 13*a*1. The sub station 52 also includes a remote controller 13*a*2. The remote controllers 13*a*1, 13*a*2 are adapted to transmit/receive information to and from each other.

A operator can select between the main station 51 and the sub station 52 using the selection switches 51*a*, 52*a*. When the operator moves from the main station 51 to the sub station 52 to take the helm for example, the operator presses the selection switch 51*a* or the selection switch 52*a* to switch between the main station 51 and the sub station 52. Since the remote controller 13*a*1 of the main station 51 and the remote controller 13*a*2 of the sub station 52 can transmit/receive information to and from each other, the remote controller 13*a*2 of the sub station 52 can receive information from the remote controller 13*a*1 of the main station 51 when the steering station is switched from the main station 51 to the sub station 52. As a result, when the operator takes the helm at the sub station 52, the operator can operate the levers 14L, 4R in the same manner as operating the levers 14L, 14R of the main station 51. Thus, even after the steering station is switched, the operator can operate the boat in the same manner.

The remote controller 13*a*1 of the main station 51 collectively controls switching between the levers 14L, 14R of the main station 51 and the levers 14L, 14R of the sub station 52. The remote controller 13*a*2 of the substation 52 only transmits to the remote controller 13*a*1 of the main station 51 positions of the two remote control levers 14L, 14R. Thus, system processing is simple.

Since the remote controller 13*a*1 of the main station 51 transmits and receives information to and from the remote controller 13*a*2 of the sub station 52, the remote controller 13*a*1 can collectively control switching between the levers 14L, 14R of the main station 51 and the levers 14L, 14R of the sub station 52. As a result, the remote controller 13*a*2 of the sub station 52 needs to only transmit the positions of the levers 14L, 14R to the remote controller 13*a*2 of the main station 51.

The remote controller 13*a*1 of the main station 51 and the remote controller 13*a*2 of the sub station 52 sequentially transmit to each other a current status of the associated levers 14L, 14R even when one of the remote controllers is determining whether or not the mode of operation through the levers 14L, 14R has been switched. As a result, even in the case of instantaneous power interruption, a reset of the microcomputer, or on/off operation of the main switches, the remote controller executing the lever switching control can receive information on the preceding operation of the associated levers from the other remote controller, thereby returning the levers to the status before the instantaneous power interruption, reset of the microcomputer, or on/off operation of the main switches.

Figure 25:
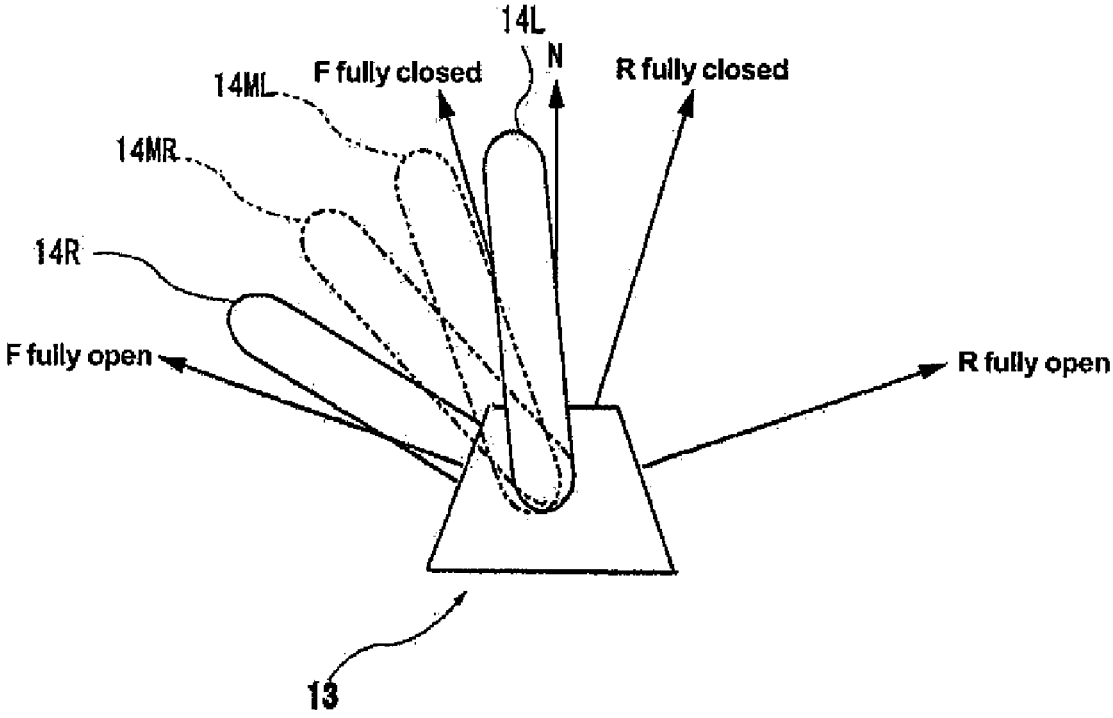
FIG. 25 illustrates a remote controller that has two actual control levers and two imaginary control levers for controlling four propulsion units in accordance with another preferred embodiment of the present invention.
Figure 26:
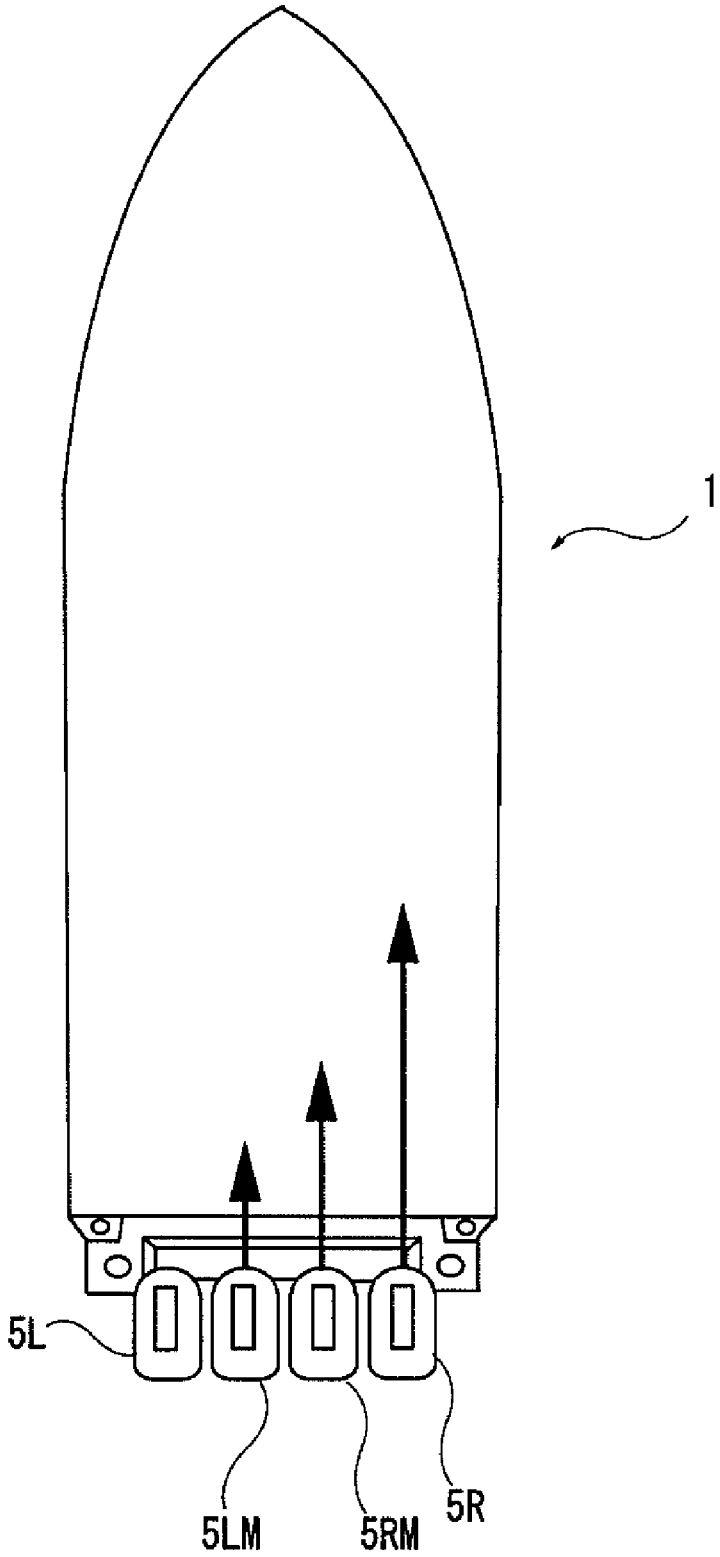
FIG. 26 illustrates the propulsion forces provided by the four propulsion units acting upon a boat that is controlled by the remote controller illustrated in FIG. 25.

FIGS. 25 and 26 illustrate another preferred embodiment of the present invention. In the foregoing embodiments, the illustrated boat 1 has included only three propulsion units. However, the present invention is also applicable to a boat with four or more propulsion units. FIGS. 25 and 26 illustrate how the system can control four propulsion units by modifying the control arrangement of the foregoing embodiments.

FIG. 25 illustrates a remote controller 13 that has two actual control levers and two imaginary control levers for controlling four propulsion units in accordance with another preferred embodiment of the present invention. FIG. 26 illustrates the propulsion forces provided by the four propulsion units 5L, 5LM, 5RM, 5R acting upon a boat 1 that is controlled by the remote controller 13 illustrated in FIG. 25. The common structure between the preceding embodiments and the embodiment illustrated in FIGS. 25 and 26 have the same reference numerals.

As shown in FIG. 26, the four propulsion units are arranged side-by-side on the transom. The propulsion units are referred to, in order from the left, as left propulsion unit 5L, left middle propulsion unit 5LM, right middle propulsion unit 5RM, and right propulsion unit 5R. A remote control lever 14L indicated by a solid line in FIG. 25 controls the shift and the opening of a throttle valve 8*a* (i.e. propulsion force) of the left propulsion unit 5L. A remote control lever 14R also indicated by a solid line in FIG. 25 controls the shift and the opening of a throttle valve 8*a* (i.e. propulsion force) of the right propulsion unit 5R. A remote control lever 14LM indicated by chain double-dashed line in FIG. 25 is an imaginary lever whose position is indicative of the operational state of the left middle propulsion unit 5LM. A remote control lever 14RM also indicated by chain double-dashed line in FIG. 25 is an imaginary lever whose position is indicative of the operational state of the right middle propulsion unit 5RM.

Control means 17*c* determines the positions of the left and right remote control levers 14L, 14R. Processing units 17L, 17R divide the range of movement for the imaginary levers into three parts between the positions of the levers 14L, 14R. The imaginary lever 14LM for the operation of the left middle propulsion unit 5LM is controlled based on a first divided point proximate to the left remote control lever 14L. The imaginary lever 14RM for the operation of the right middle propulsion unit 5RM is controlled based on a second divided point proximate to the right remote control lever 14R. The control means 17*c* outputs operation command signals based on the positions of the imaginary levers 14LM, 14RM to the respective engines 6 of the left middle propulsion unit 5LM and the right middle propulsion unit 5RM.

For example, the right remote control lever 14R is at a position proximate to the F fully open position in FIG. 25. The left remote control lever 14L is at an intermediate position between the F fully closed position and the neutral position. Thus, assuming that the imaginary left middle lever 14LM and the imaginary right middle lever 14RM are at intermediate positions between the F fully closed position and the F fully open position, the control means 17*c* outputs operation command signals based on the positions of the imaginary levers 14LM, 14RM. As a result, the magnitude and direction of propulsion force from the individual propulsion units 5L, 5LM, 5RM, 5R will be as indicated by arrow P in FIG. 26. With the engines operating as illustrated in FIG. 26, the boat 1 would turn left when advancing.

The lever moving range between the positions of the left and right remote control levers 14L, 14R are divided equally into three parts, and the imaginary levers 14LM, 14RM are assumed to be at the divided points. The left middle propulsion unit 5ML and the right middle propulsion unit 5RM are controlled in response to the assumed positions of the imaginary levers 14LM, 14RM.

The present invention is applicable to a steering system for a boat with three or more propulsion units. The propulsion units may be arranged in a side-by-side arrangement. Should a failure of one propulsion unit occur, the operator can continue to operate the remaining propulsion units in the same manner as the operator operated the propulsions units prior to the failure.

In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A boat steering system comprising:

at least three propulsion units including a left unit, a right unit, and a middle unit;

left and right control levers associated with the at least three propulsion units to control operation of the at least three propulsion units;

a main switch for each of the at least three propulsion units; and a controller being configured to automatically change the association between the left and right control levers and the at least three propulsion units if the main switch of any of the at least three propulsion units is turned off.

2. The boat steering system according to claim 1 further comprising a main switch status detection means for detecting the operational status of the main switch.

3. The boat steering system according to claim 1, wherein the controller controls the middle unit based on a position of the left lever when only the main switch for the left unit is off.

4. The boat steering system according to claim 1, wherein the controller controls the middle unit based on a position of the right lever when only the main switch for the right unit is off.

5. The boat steering system according to claim 1, wherein the controller controls the middle unit based on a position of one of the right or left levers when the main switches for the right ad left units are off.

6. The boat steering system according to claim 1, wherein the association between the left and right levers and the at least three propulsion units is switched when the left and right levers are in a neutral position.

7. The boat steering system according to claim 1 further comprising a lever selection switch for selecting how the left and right control levers are associated with the at least three propulsion units to control operation of the at least three propulsion units, wherein the controller adjusts the boat steering system in response to the lever selection switch.

8. A boat steering system comprising:

at least three propulsion units including a left unit, a right unit, and a middle Unit;

left and right control levers associated with the at least three propulsion units to control operation of the at least three propulsion units;

a main switch for each of the at least three propulsion units;

a controller being configured to automatically change the association between the left and right control levers and the at least three propulsion units if the main switch of any of the at least three propulsion units is turned off;

a lever selection switch for selecting how the left and right control levers are associated with the at least three propulsion units to control operation of the at least three propulsion units, wherein the controller adjusts the boat steering system in response to the lever selection switch; and a lever selection switch status detection means for detecting an operational status of the lever selection switch.

9. The boat steering system according to claim 8, wherein the controller switches between a first association mode, a second association mode, and third association mode each time the operational status of the lever selection switch changes, the first association mode having the at least three propulsion units associated with the left and right control levers, the second association mode having only the left and right units associated with the left and right control levers while the middle unit is in a neutral position, and the third association mode having only the middle unit associated with one of the left and right control levers while the left and right units are in the neutral position.

10. The boat steering system according to claim 9, wherein the controller does not select the second and third association modes when any of the main switches is off.

11. The boat steering system according to claim 9, wherein the controller switches to one of the first, second, or third association modes each time the lever selection switch is activated.

12. The boat steering system according to claim 8 wherein the controller switches between a first association mode and a second association mode each time the operational status of the lever selection switch changes, the first association mode having the at least three propulsion units associated with the left and right control levers, and the second association mode having the left and right units associated with one of the left and right control levers while the middle unit is associated with the other one of the left and right control levers.

13. The boat steering system according to claim 12, wherein the lever selection switch is only operable when none of the main switches are off and the left and right control levers are in a neutral position.

14. The boat steering system according to claim 1, wherein only when the left and right control levers are operated in the same forward or reverse direction is the middle unit operable in the same forward or reverse direction.

15. The boat steering system according to claim 1, wherein when the left and right control levers are operated in the same forward or reverse direction, the middle unit is operated at an intermediate position.

16. The boat steering system according to claim 1, wherein when one of the left and right control levers is in a fully open position and the other control lever is in a neutral position, if the other lever is moved to a fully closed position, the controller opens a throttle valve for the middle unit to achieve an intermediate engine speed between engine speeds of the left unit and the right unit.

17. The boat steering system according to claim 1, wherein when both the left and right control levers are both in a forward or a reverse direction and held at a position before a fully closed position, the middle unit achieves a target shift and throttle position based on a position of the one of the first and second control levers that is nearer to a neutral position.

18. A boat steering system comprising:

at least three propulsion units including a left unit, a right unit, and a middle unit;

a main station having a first set of left and right control levers, the first set of control levers being associated with the at least three propulsion units;

a sub station having a second set of left and right control levers, the second set of control levers being associated with the at least three propulsion units, wherein control of the at least three propulsion units is switchable between the main station and the sub station; and a remote controller configured to switch between the first and set sets of control levers when a steering station is switched from one station to the other;

wherein when one lever of the first set of left and right control levers is in a full open position and the other control lever is in a neutral position, if the other lever is moved to a fully closed position, the controller opens a throttle valve for the middle unit to achieve an intermediate engine speed between engine speeds of the left unit and the right unit.

19. The boat steering system according to claim 18, wherein the remote controller is located at the main station.

20. The boat steering system according to claim 18 further comprising a second remote controller, wherein the first remote controller sequentially transmits to the second remote controller a status of the set of left and right control levers associated with the first remote controller.

21. The boat steering system according to claim 18, wherein only when the first set of left and right control levers are operated in the same forward or reverse direction is the middle unit operable in the same forward or reverse direction.

22. The boat steering system according to claim 18, wherein when the first set of left and right control levers are operated in the same forward or reverse direction, the middle unit is operated at an intermediate position.

* * * * *

UNITED STATES PATENT AND TRADEMARK OFFICE

CERTIFICATE OF CORRECTION

PATENT NO. : 7,510,449 B2
APPLICATION NO. : 11/689314
DATED : March 31, 2009
INVENTOR(S) : Makoto Ito et al.

It is certified that error appears in the above-identified patent and that said Letters Patent is hereby corrected as shown below:

Title Page, Line 2 (Item 76 Inventors), please change "Hamamatsi-shi," to --Hamamatsu-shi,--.

Title Page, Line 4 (Item 76 Inventors), please change "Hamamatsi-shi," to --Hamamatsu-shi,--.

Title Page, Line 7 (Item 76 Inventors), please change "Hamamatsi-shi," to --Hamamatsu-shi,--.

In Column 19, Line 45 (Approx.), in Claim 5, please change "ad" to --and--.

In Column 19, Line 59, in Claim 8, please change "Unit;" to --unit;--.

In Column 21, Line 11 (Approx.), in Claim 18, please change "full" to --fully--.

Signed and Sealed this

Fourth Day of May, 2010

David J. Kappos

David J. Kappos
*Director of the United States Patent and Trademark Office*